US007472781B2

(12) United States Patent
Yoshioka

(10) Patent No.: US 7,472,781 B2
(45) Date of Patent: Jan. 6, 2009

(54) BILL HANDLING DEVICE AND CONTROL SYSTEM THEREOF

(75) Inventor: Kazuei Yoshioka, Koto-ku (JP)

(73) Assignees: Aruze Corp., Tokyo (JP); Seta Corp., Tokyo (JP)

( * ) Notice: Subject to any disclaimer, the term of this patent is extended or adjusted under 35 U.S.C. 154(b) by 0 days.

(21) Appl. No.: 11/451,460

(22) Filed: Jun. 13, 2006

(65) Prior Publication Data

US 2007/0125622 A1 Jun. 7, 2007

(30) Foreign Application Priority Data

Jun. 17, 2005 (JP) ..... 2005-178268

(51) Int. Cl.
*G07F 9/10* (2006.01)
*B65H 31/30* (2006.01)

(52) U.S. Cl. ..... 194/350; 271/213

(58) Field of Classification Search ..... 194/350, 194/206; 271/163, 213, 207, 306, 214; 414/789.9
See application file for complete search history.

(56) References Cited

U.S. PATENT DOCUMENTS

| | | | | |
|---|---|---|---|---|
| 4,186,977 | A | 2/1980 | Gilovich et al. | |
| 4,784,274 | A * | 11/1988 | Mori et al. | 209/534 |
| 5,372,361 | A * | 12/1994 | Isobe et al. | 271/181 |
| 5,419,423 | A * | 5/1995 | Ishida et al. | 194/206 |
| 5,887,695 | A | 3/1999 | Hatamachi et al. | |
| 6,540,090 | B1 * | 4/2003 | Sakai et al. | 209/534 |
| 6,695,307 | B2 | 2/2004 | Kanagawa | |

FOREIGN PATENT DOCUMENTS

| | | |
|---|---|---|
| JP | 7-210727 | 8/1995 |
| JP | 2002-326736 | 11/2002 |
| JP | 2004-195035 | 7/2004 |
| TW | 156243 | 4/1991 |
| TW | 241553 | 2/1995 |
| TW | 306306 | 5/1997 |
| WO | WO 98/03945 | 1/1998 |

* cited by examiner

*Primary Examiner*—Patrick Mackey
*Assistant Examiner*—Mark Beauchaine
(74) *Attorney, Agent, or Firm*—Oblon, Spivak, McClelland, Maier & Neustadt, P.C.

(57) ABSTRACT

There is provided a bill handling device in which the size of the device can be reduced by disposing various component members in a limited amount of installation space in a space-efficient manner and efficient bill collection is further realized. The bill handling device includes a bill transport mechanism for transporting a bill inserted from a bill insertion slot along the insertion direction and ejecting the bill toward a bill push area located downstream of the bill transport mechanism; a press plate provided on one side of a housing and pressing the bill ejected in the bill push area toward the other side; a stacking tray reciprocally movable along the insertion direction and stacking and storing the bill pressed by the press plate; a stacking tray drive mechanism for reciprocally moving the stacking tray; a shutter mechanism having a shutter, the shutter mechanism opening and closing the shutter through which the front end area of the stacking tray can project. The stacking tray holds the bill such that when the front end portion of the stacking tray projects from the housing through the shutter, the front end portion of the stacked and stored bill is exposed.

10 Claims, 16 Drawing Sheets

BILL HANDLING DEVICE AND CONTROL SYSTEM THEREOF

RELATED APPLICATION

This application claims the priority of Japanese Patent Application No. 2005-178268 filed on Jun. 17, 2005, which is incorporated herein by reference.

BACKGROUND OF THE INVENTION

1. Field of the Invention

The present invention relates to a bill handling device that is installed in an amusement arcade where Pachinko gaming machines, slot machines and the like (hereinafter referred to as "game machine") are installed and that can be disposed in between game machines. The invention also relates to a bill handling device control system for controlling such a bill handling device.

2. Description of the Related Art

An amusement arcade such as a Pachinko parlor generally has an area (also referred to as "bank") where a large number of game machines are installed, and for players convenience, in between adjacent game machines is installed a vertically long game medium dispensing device (also referred to as "sandwich device") for dispensing pachinko balls or coins (game mediums). The game medium dispensing device is mounted on a frame fixed in between the game machines. When the game medium dispensing device receives a bill, coin, prepaid card or the like through a corresponding insert slot, the device itself dispenses game mediums or sends the game machine a signal prompting it to dispense game mediums. For example, the game medium dispensing device may be a bill handling device capable of handling bills that includes a bill discriminator for discriminating an inserted bill and a bill container (repository) for storing bills validated in the bill discriminator.

To effectively use the space of an amusement arcade, it is desirable to install a large number of game machines in a space-efficient manner and accordingly the above-mentioned bill handling device installed in between the game machine housings is required to be as small in size as possible. That is, it is desired to reduce the distance between adjacent game machines and install the bill handling device therebetween in a space-efficient manner.

To this end, there is proposed a bill handling machine including a bill discriminator and a bill container installed adjacent to each other in a vertical direction, as disclosed, for example, in Japanese Unexamined Patent Publication No. 2004-195035. In this bill handling device, a bill in a vertical position is inserted and the bill, if validated, is transported downward and stacked and stored in the bill container.

In the above bill handling device, the arrangement in which the bill discriminator and bill container are vertically juxtaposed requires a large vertical space, limiting the space for accommodating other devices (such as a coin/prepaid card handling device).

Although the above game medium dispensing device is installed in an approximately 40 mm wide space in consideration of saving space, the width can be reduced for the purpose of only storing bills. For example, considering the bill collection cycle by the operator (conducted at the end of the operation of the day), again, the width of the bill container can be reduced. These indicate that the above bill handling device takes up an unnecessarily large space. Normally, about 10 mm (about 100 bills) will be enough for the bill collection cycle mentioned above if the stacked bills are compressed in an efficient manner, allowing the portion storing bills and the portion receiving bills to be located side-by-side. That is, the configuration and layout of a bill transport mechanism provided in a bill insert portion, various drive sources such as drive motors, a bill container for storing bills, as well as the way to stack bills in the bill container in a compressed manner could be skillfully arranged, allowing the bill discriminator and bill container to be horizontally disposed adjacent to each other, resulting in a space-saving bill handling device.

As disclosed in Japanese Unexamined Patent Publication No. 2004-195035 referred above, the bill container for storing bills is usually configured such that the operator pulls it frontward and grabs the stacked bills and picks them up sideways from the side of the pulled-out bill container. This bill collection process requires labor and time when the operator sequentially removes bills from a large number of bill handling devices. In particular, conventional bill container is configured such that the operator inserts a key into the bill container, manually pulls it out to remove bills, and then pushes the bill container back, resulting in a current labor and time-intensive bill collection process.

SUMMARY OF THE INVENTION

The invention has been made in view of the above situations and aims to provide a bill handling device in which the size of the device can be reduced by disposing various component members in a limited amount of installation space in a space-efficient manner and efficient bill collection is further realized. The invention also aims to provide a bill handling device control system capable of controlling the bill handling device configured as described above in an efficient manner during the bill collection process.

To solve the above problems, the bill handling device according to an aspect of the invention comprises a housing; a bill insertion slot provided on the front side of the housing, through which a bill can be inserted; a bill transport mechanism for transporting the bill inserted from the bill insertion slot along the insertion direction and ejecting the bill toward a bill push area located downstream of the bill transport mechanism; a bill press mechanism provided on one side of the housing and pressing the bill ejected in the bill push area toward the other side; a stacking tray reciprocally movable along the insertion direction and stacking and storing the bill pressed by the bill press mechanism; a stacking tray drive mechanism for reciprocally moving the stacking tray; and a shutter mechanism having a shutter provided on the housing, the shutter mechanism opening and closing the shutter through which the front end area of the stacking tray can project, the shutter mechanism having a lock mechanism for preventing the shutter from opening; wherein the stacking tray holds the bill such that when the front end portion of the stacking tray projects from the housing through the shutter, the front end portion of the stacked and stored bill is exposed.

According to the bill handling device configured as described above, the bill inserted through the bill insertion slot is transported by the bill transport mechanism and ejected toward the bill push area located downstream of the bill transport mechanism. Since in the bill push area, there is no transport mechanism (such as transport rollers) for transporting bills in the insertion direction, space can be provided in the lateral direction of the housing, where the bill press mechanism and the stacking tray for stacking and storing bills can be disposed in the lateral direction in a space-efficient manner.

The bills successively ejected in the bill push area are successively stacked and stored in the stacking tray provided on one side by the bill press mechanism provided on the other side. The stacking tray is configured to be reciprocally moved by the stacking tray drive mechanism, and during the bill collection process, the lock mechanism is released to open the shutter, through which the front end portion of the stacking tray projects. Since the bills stacked and stored in the stacking tray are held such that the front end portion of the bills is exposed, the operator can grab and pick the exposed bills out, allowing the bill collection process to be carried out in an efficient manner.

To solve the above problems, the bill handling device control system according to another aspect of the invention comprises a signal transmission module for transmitting a release signal for releasing the lock mechanism to the bill handling device, and a controller for driving the shutter mechanism to open the shutter and driving the stacking tray drive mechanism such that the stacking tray projects from the housing when the bill handling device received the release signal.

According to the above configuration, in the bill collection process, the release signal transmitted to the bill handling device releases the lock mechanism for the shutter and the stacking tray automatically projects from the housing. Thus, for example, a management server for managing the facility in a bank where a large number of game machines are installed can transmit the release signal to make all the bill handling devices in the bank ready for bill collection in a single operation (controlling each of the bill handling devices to eject the stacking tray such that it projects from the housing), allowing the bill collection process for the entire bank to be easily carried out. The release signal may be transmitted via the management server for managing a large number of bill handling devices as described above, or via a mobile terminal in possession of the operator. The signal transmission module or controller may also drive the stacking tray from which the bills have been collected back to the storing position and lock the shutter.

BRIEF DESCRIPTION OF THE SEVERAL VIEWS OF THE INVENTION OF THE DRAWINGS

The accompanying drawings, which are incorporated in and constitute a part of the specification, illustrate embodiments of the invention, and together with the general description given above and the detailed description of the embodiments given below, serve to explain the principals of the invention.

Figure 9A:
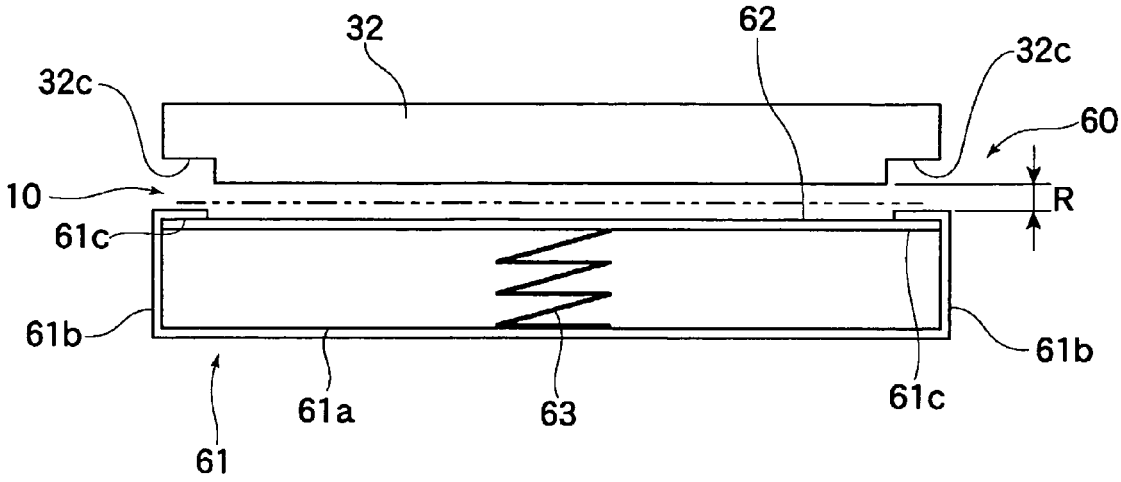
Figure 9B:
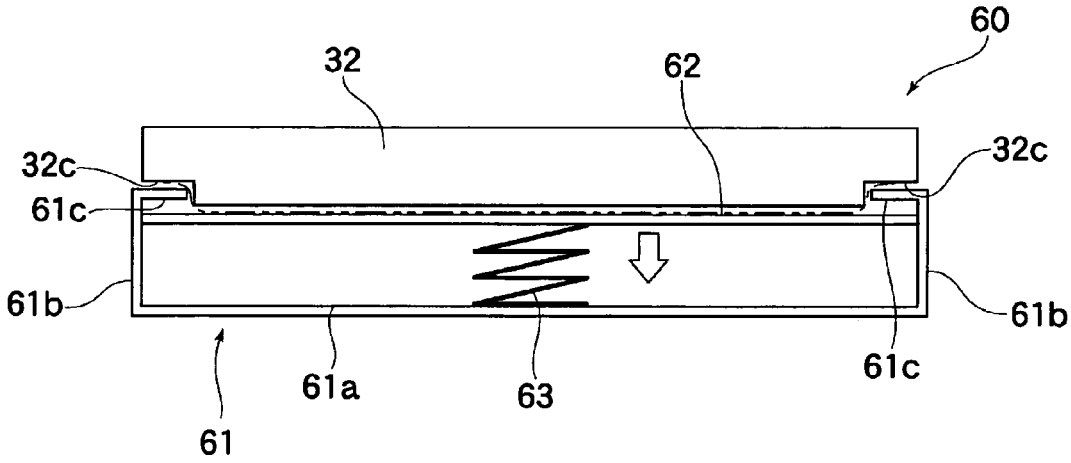
Figure 9C:
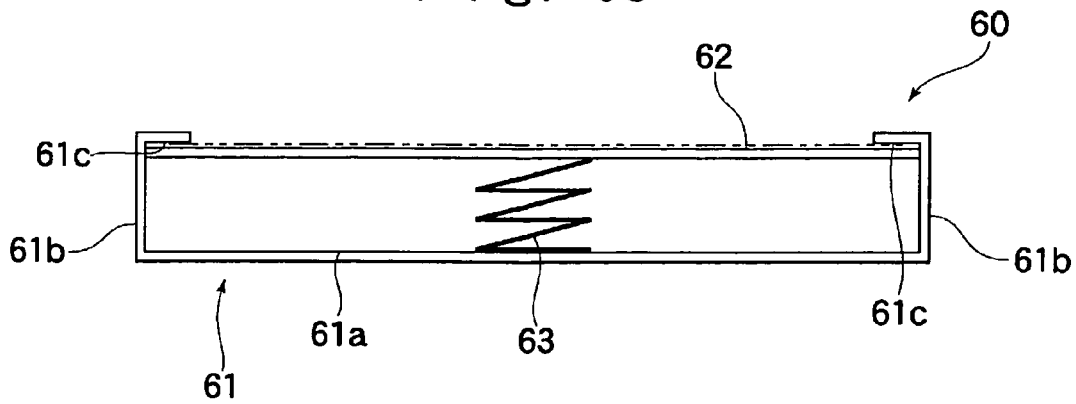
Figure 10:
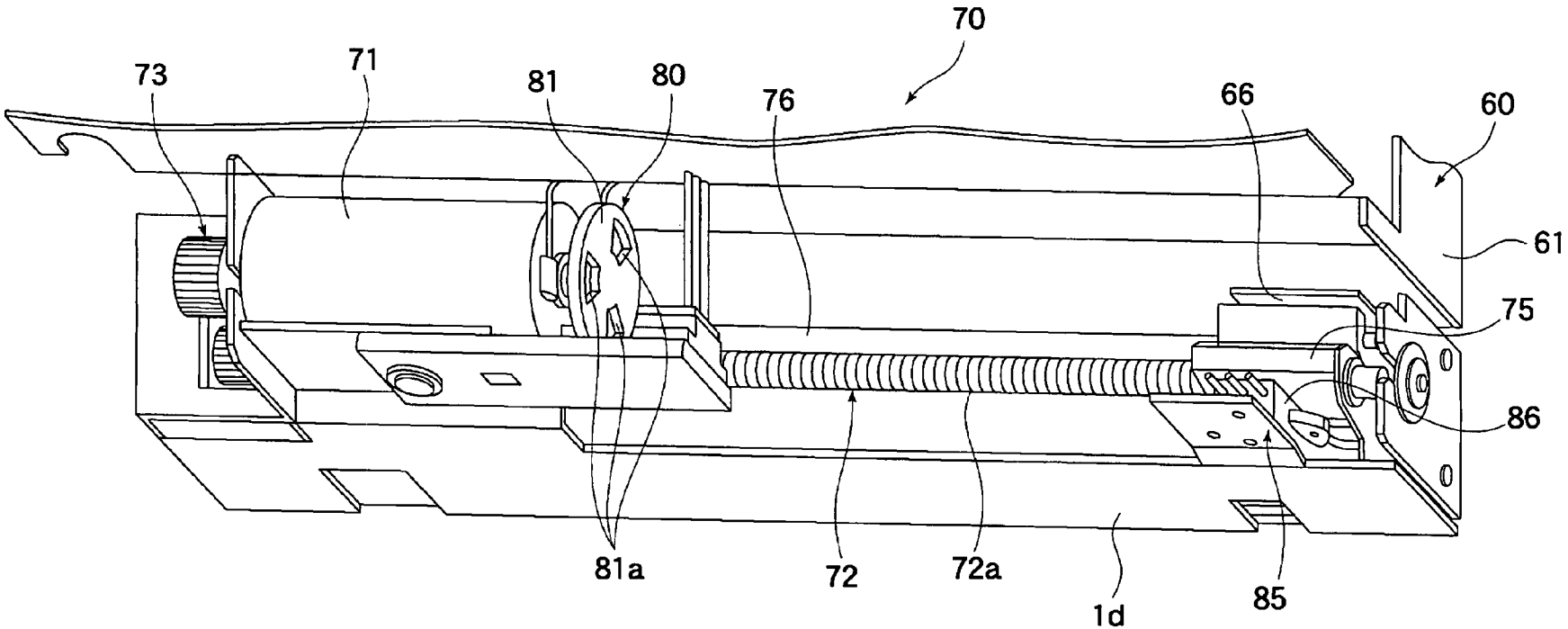
Figure 11:
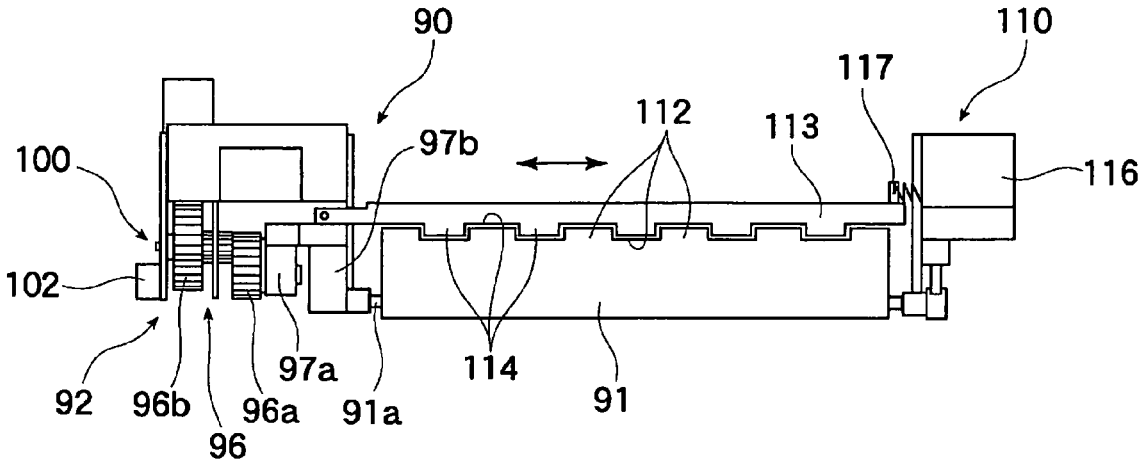
Figure 12:
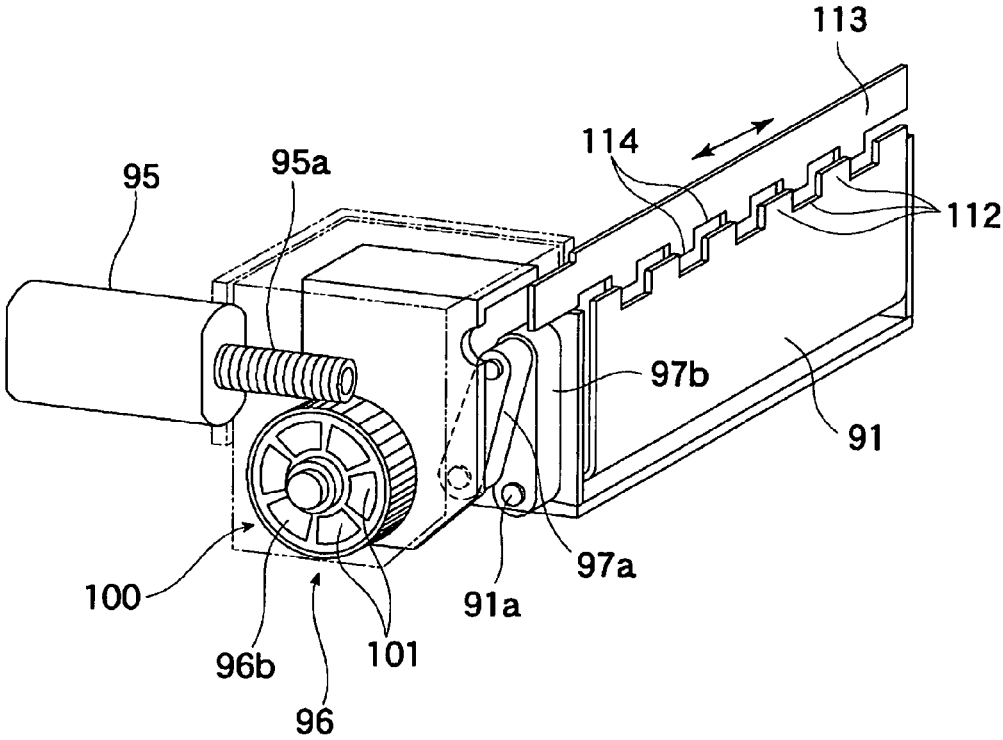
Figure 13A:
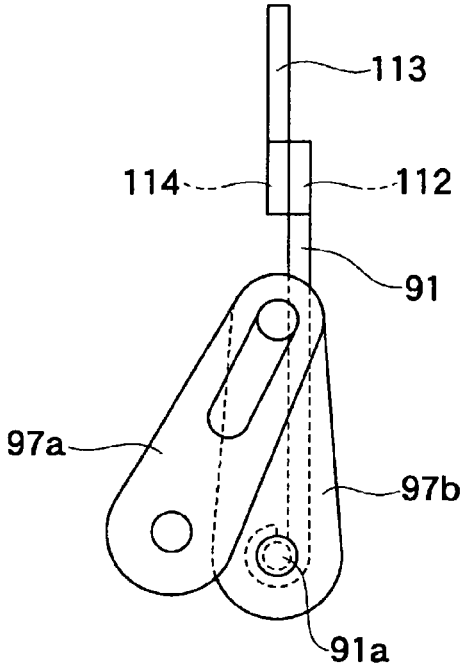
Figure 13B:
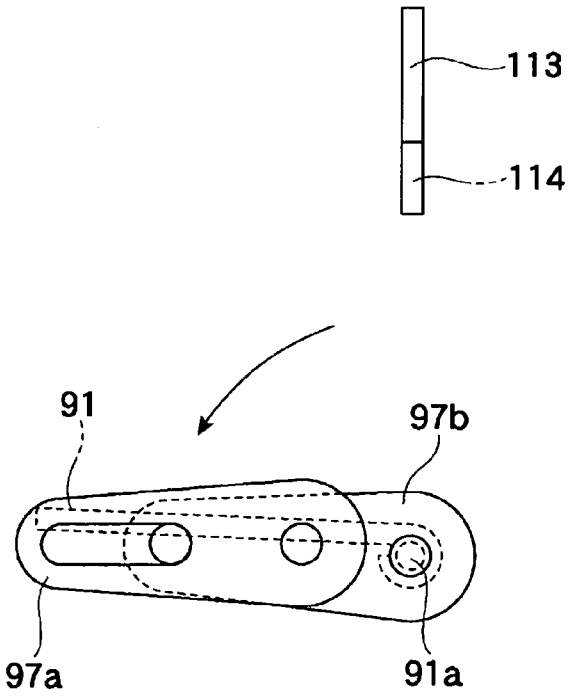
Figure 14:
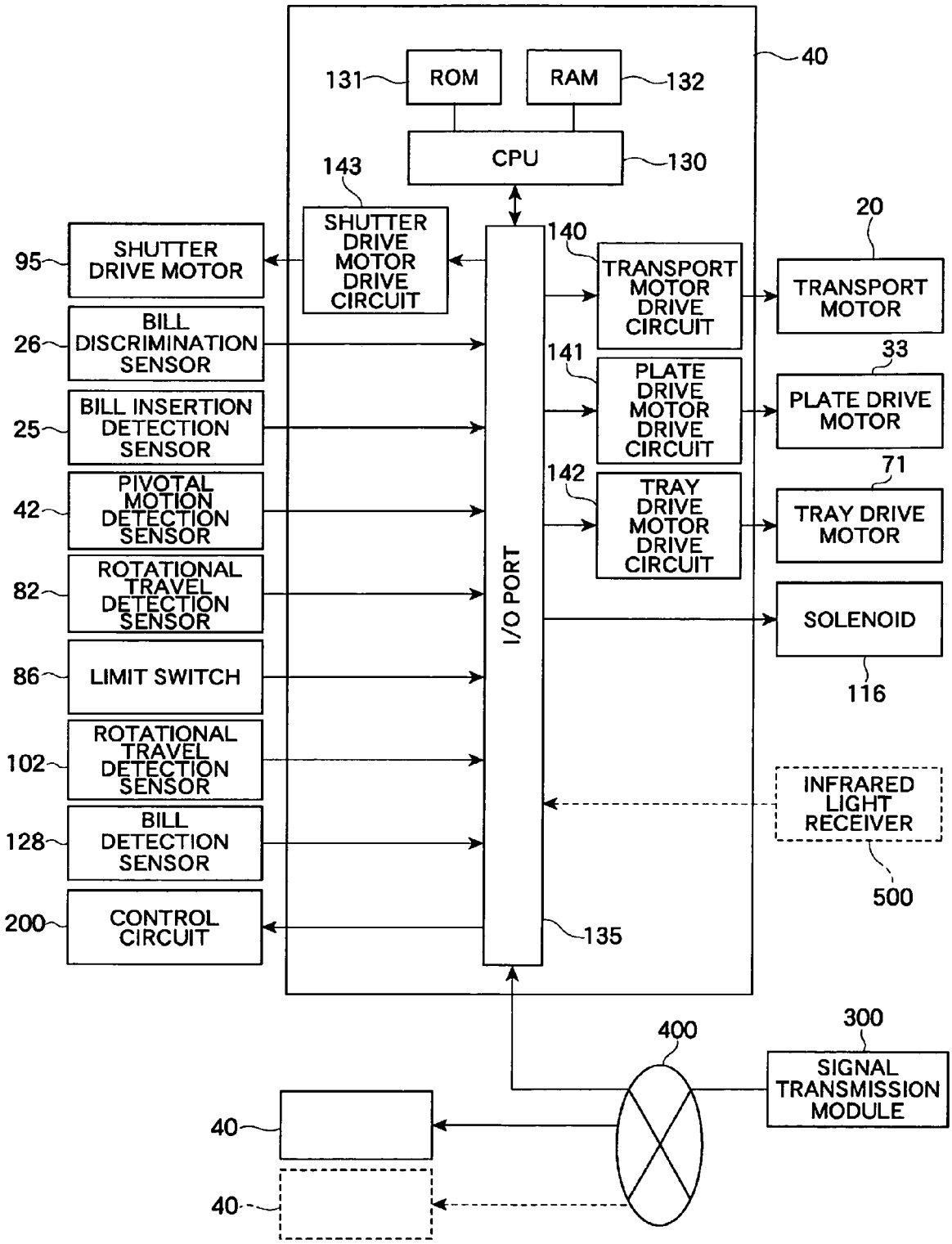
Figure 15:
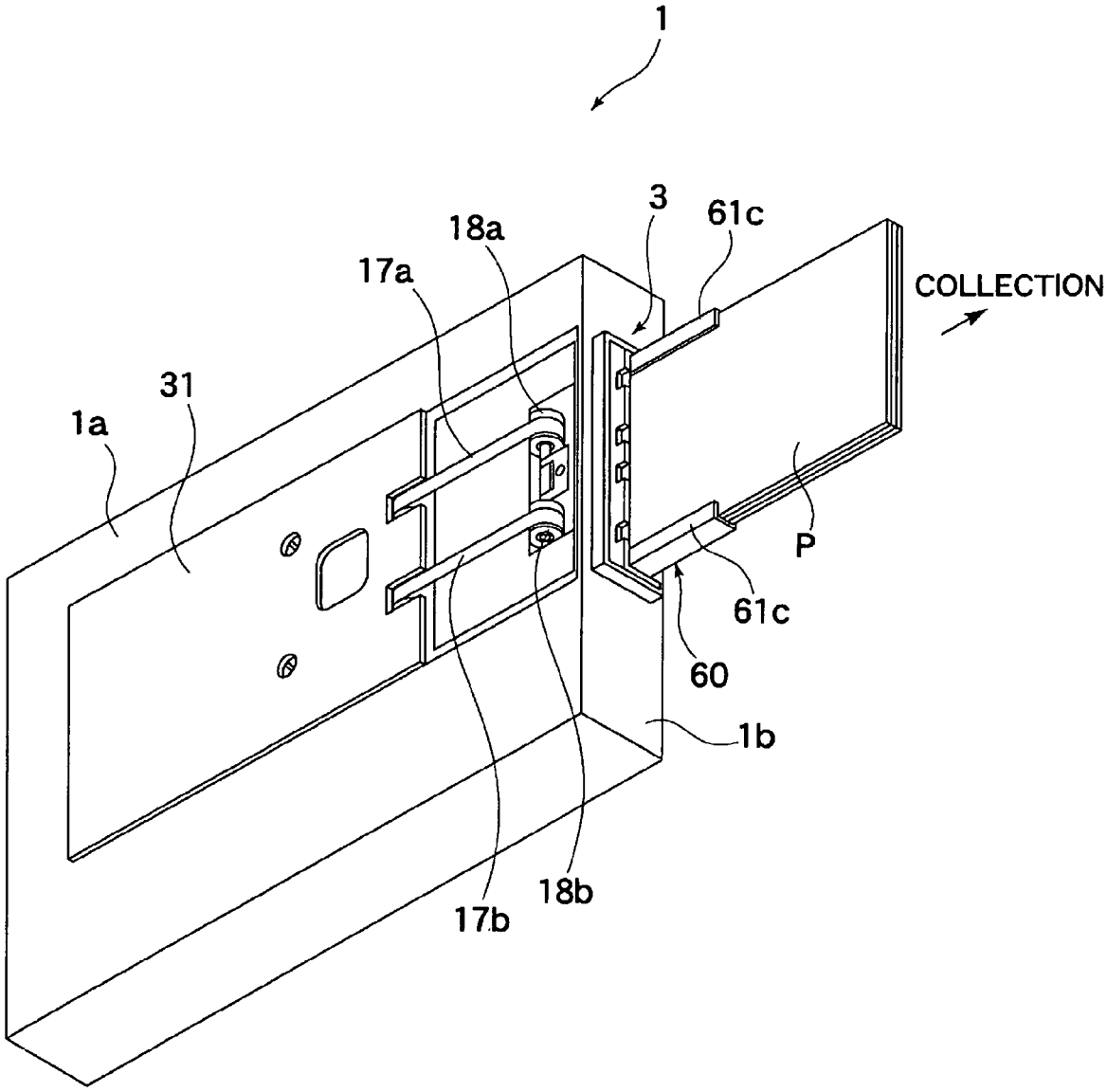

FIG. 9A explains how the press plate presses the bill into the stacking tray and shows the state before the bill is pressed;

FIG. 9B explains how the press plate presses the bill into the stacking tray and shows the state when the bill is being pressed;

FIG. 9C explains how the press plate presses the bill into the stacking tray and shows the state after the bill is pressed;

FIG. 10 shows the arrangement of the stacking tray drive mechanism;

FIG. 11 is a front view showing the arrangement of the shutter mechanism and the locking mechanism;

FIG. 12 is a perspective view showing the arrangement of the shutter drive mechanism;

FIG. 13A is a side view of the shutter mechanism when it is locked;

FIG. 13B is a side view of the shutter mechanism when it is unlocked;

FIG. 14 is a block diagram showing an exemplary arrangement of the controller for controlling the operation of the bill handling device; and FIG. 15 shows the stacking tray when it is ejected.

DESCRIPTION OF THE PREFERRED EMBODIMENTS

According to a first aspect of the invention, there is provided a bill handling device (e.g., a bill handling device 1) of this embodiment comprising: a housing (e.g., housing 1*a*); a bill insertion slot (e.g., a bill insertion slot 3A) provided on the front side of the housing, through which a bill can be inserted; a bill transport mechanism (e.g., a bill transport mechanism 7) for transporting the bill inserted from the bill insertion slot along the insertion direction and ejecting the bill toward a bill push area located downstream of the bill transport mechanism; a bill press mechanism (e.g., a bill press mechanism 30) provided on one side of the housing and pressing the bill ejected in the bill push area toward the other side; a stacking tray (e.g., a stacking tray 60) reciprocally movable along the insertion direction and stacking and storing the bill pressed by the bill press mechanism; a stacking tray drive mechanism (e.g., a stacking tray drive mechanism 70) for reciprocally moving the stacking tray; and a shutter mechanism (e.g., a shutter mechanism 90) having a shutter provided on the housing, the shutter mechanism opening and closing the shutter through which the front end area of the stacking tray can project, the shutter mechanism having a lock mechanism for preventing the shutter from opening; wherein the stacking tray holds the bill such that when the front end portion of the stacking tray projects from the housing through the shutter, the front end portion of the stacked and stored bill is exposed.

According to the bill handling device configured as described above, the bill inserted through the bill insertion slot is transported by the bill transport mechanism and ejected toward the bill push area located downstream of the bill transport mechanism. Since in the bill push area, there is no transport mechanism (such as transport rollers) for transporting bills in the insertion direction, space can be provided in the lateral direction of the housing, where the bill press mechanism and the stacking tray for stacking and storing bills can be disposed in the lateral direction in a space-efficient manner.

The bills successively ejected in the bill push area are successively stacked and stored in the stacking tray provided on one side by the bill press mechanism provided on the other side. The stacking tray is configured to be reciprocally moved by the stacking tray drive mechanism, and during the bill collection process, the lock mechanism is released to open the shutter, through which the front end portion of the stacking tray projects. Since the bills stacked and stored in the stacking tray are held such that the front end portion of the bills is exposed, the operator can grab and pick the exposed bills out, allowing the bill collection process to be carried out in an efficient manner.

According to another aspect of the invention, the stacking tray (e.g., the stacking tray 60) includes stopper wings (e.g., stopper wings 61*c*) engageable with the both longitudinal edges of the bill, a bill stacking plate for stacking the bill, and a biasing spring for pressing the bill stacked on the bill stacking plate toward the stopper wings.

According to the stacking tray configured as described above, the bill pressed by the bill press mechanism passes over the stopper wings and is successively stacked and stored on the bill stacking plate. That is, by simply providing the stopper wings on the stacking tray against which the both edges of the bill are pressed, the stacked and stored bill can be easily separated from a bill to be ejected in the bill push area, allowing the stacking tray and the bill press mechanism to be disposed adjacent to each other in the lateral direction, while ensuring an installation space for both the components in a space-efficient manner. That is, a sufficient bill stacking space can be provided.

According to another aspect of the invention, the stacking tray (e.g., the stacking tray 60) is formed such that the length of the bill stacking plate is shorter than the length of the inserted bill.

According to the above configuration, since the length of the bill stacking plate is shorter than the length of the bill, when the stacking tray projects from the housing, the stacked and stored bills can be easily grabbed at their front end portion, allowing the bill collection process to be carried out more easily.

According to another aspect of the invention, the stacking tray drive mechanism (e.g., the stacking tray drive mechanism 70) has a travel detection module capable of detecting the travel of the stacking tray.

According to the above configuration, since the travel of the stacking tray can be detected, it is possible to control an appropriate projection amount of the stacking tray relative to the housing. It is also possible to stop the stacking tray at a predetermined position, eliminating a load on a drive source, i.e., a motor of the stacking tray drive mechanism.

According to another aspect of the invention, the stacking tray drive mechanism (e.g., the stacking tray drive mechanism 70) has a position detection module for detecting whether or not the stacking tray is in a storing position in the housing.

According to the above configuration, in the bill collection process and after the bills are collected from the stacking tray, it is possible to automatically return the stacking tray to the storing position. For example, provided that the position detection module has not detected the stacking tray and no bill exists in the stacking tray in the bill collection process, it is possible to drive the stacking tray drive mechanism to return the stacking tray to the storing position. This allows the stacking tray, upon the completion of the bill collection process, to automatically return to the storing position.

According to another aspect of the invention, there is provided a bill handling device control system capable of controlling the bill handling device according to any one of the aspects described above. The control system comprises a signal transmission module (e.g., a signal transmission module 300) for transmitting a release signal for releasing the lock mechanism to the bill handling device, and a controller for driving the shutter mechanism to open the shutter and driving the stacking tray drive mechanism such that the stacking tray projects from the housing when the bill handling device received the release signal.

According to the above configuration, in the bill collection process, the release signal transmitted to the bill handling device releases the lock mechanism for the shutter and the stacking tray automatically projects from the housing. Thus, for example, a management server for managing the facility in a bank where a large number of game machines are installed can transmit the release signal to make all the bill handling devices in the bank ready for bill collection in a single operation (controlling each of the bill handling devices to eject the stacking tray such that it projects from the housing), allowing the bill collection process for the entire bank to be easily carried out. The release signal may be transmitted via the management server for managing a large number of bill handling devices as described above, or via a mobile terminal in possession of the operator. The signal transmission module or controller may also drive the stacking tray from which the bills have been collected back to the storing position and lock the shutter.

According to another aspect of the invention, the stacking tray (e.g., the stacking tray 60) is provided with a bill detection sensor for detecting the presence of a bill, and when the bill detection sensor does not detect the presence of a bill and the stacking tray remains projected from the housing for a predetermined period of time, the controller controls the stacking tray drive mechanism to return the stacking tray into the housing.

According to such a control system, since the stacking tray automatically returns into the housing after the collection process without having to manually return the stacking tray to its initial position, the operator only needs to pull the bills out, resulting in improved operation efficiency.

According to another aspect of the invention, the stacking tray (e.g., the stacking tray 60) is provided with a bill detection sensor for detecting the presence of a bill, and when the bill detection sensor does not detect the presence of a bill, the controller drives the lock mechanism to lock the shutter to prevent it from opening.

According to such a control system, after the lock mechanism is released, the shutter is automatically locked if no bill exists in the stacking tray, eliminating the possibility that the operator forgets to lock the shutter.

According to the invention, there is provided a bill handling device in which the size of the device can be reduced by disposing various component members in a limited amount of installation space in a space-efficient manner and efficient bill collection is further realized. There is also provided a bill handling device control system capable of controlling the above bill handling device in an efficient manner during the bill collection process.

Additional objects and advantage of the invention will be set forth in the description which follows, and in part will be obvious from the description, or may be learned by practice of the invention. The objects and advantages of the invention may be realized and obtained by means of the instrumentalities and combinations particularly pointed out hereinafter.

An embodiment of the invention will be described below with reference to the drawings.

Figure 1:
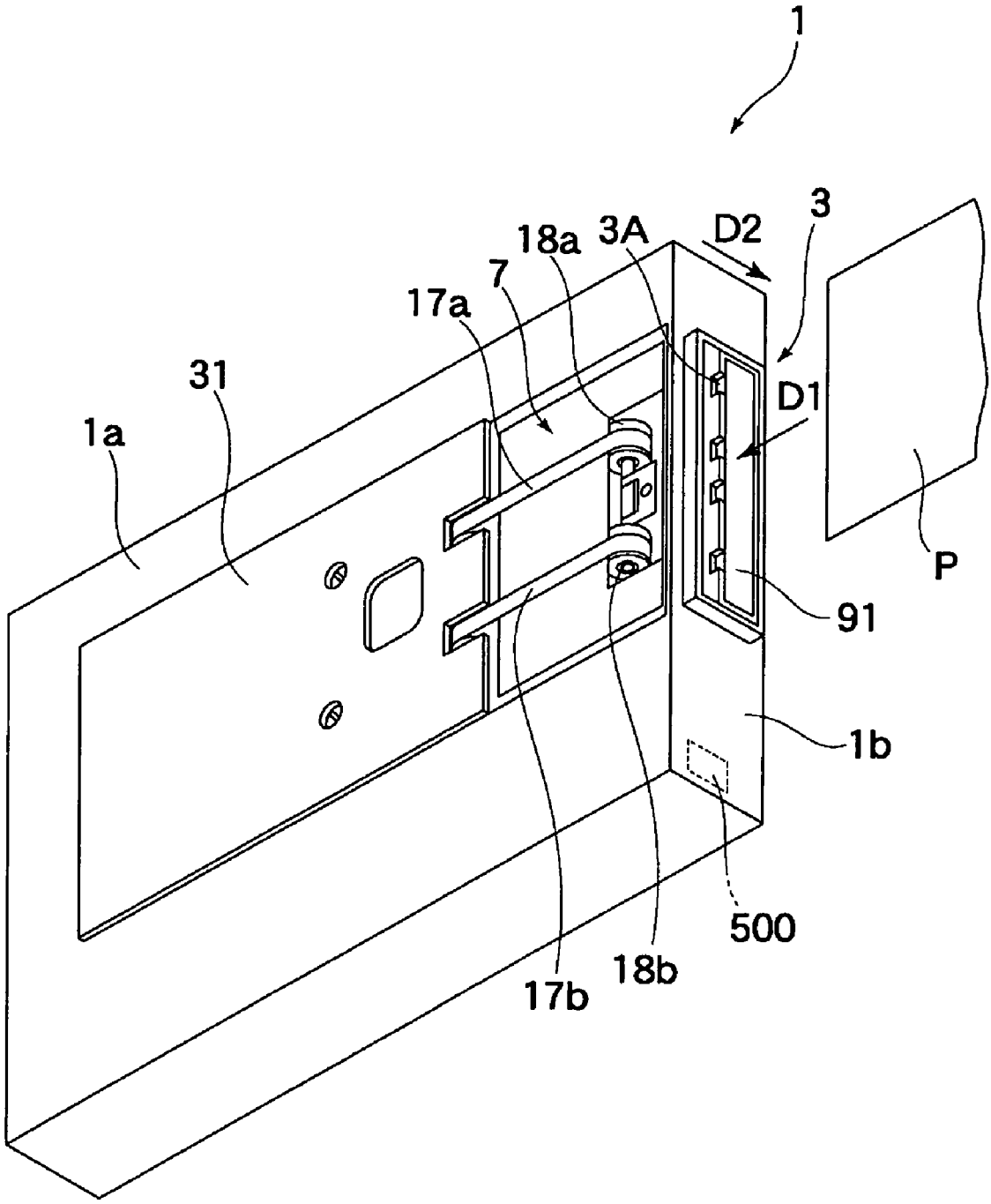
FIG. 1 is a perspective view showing the overall arrangement of the bill handling device according to the invention.
Figure 2:
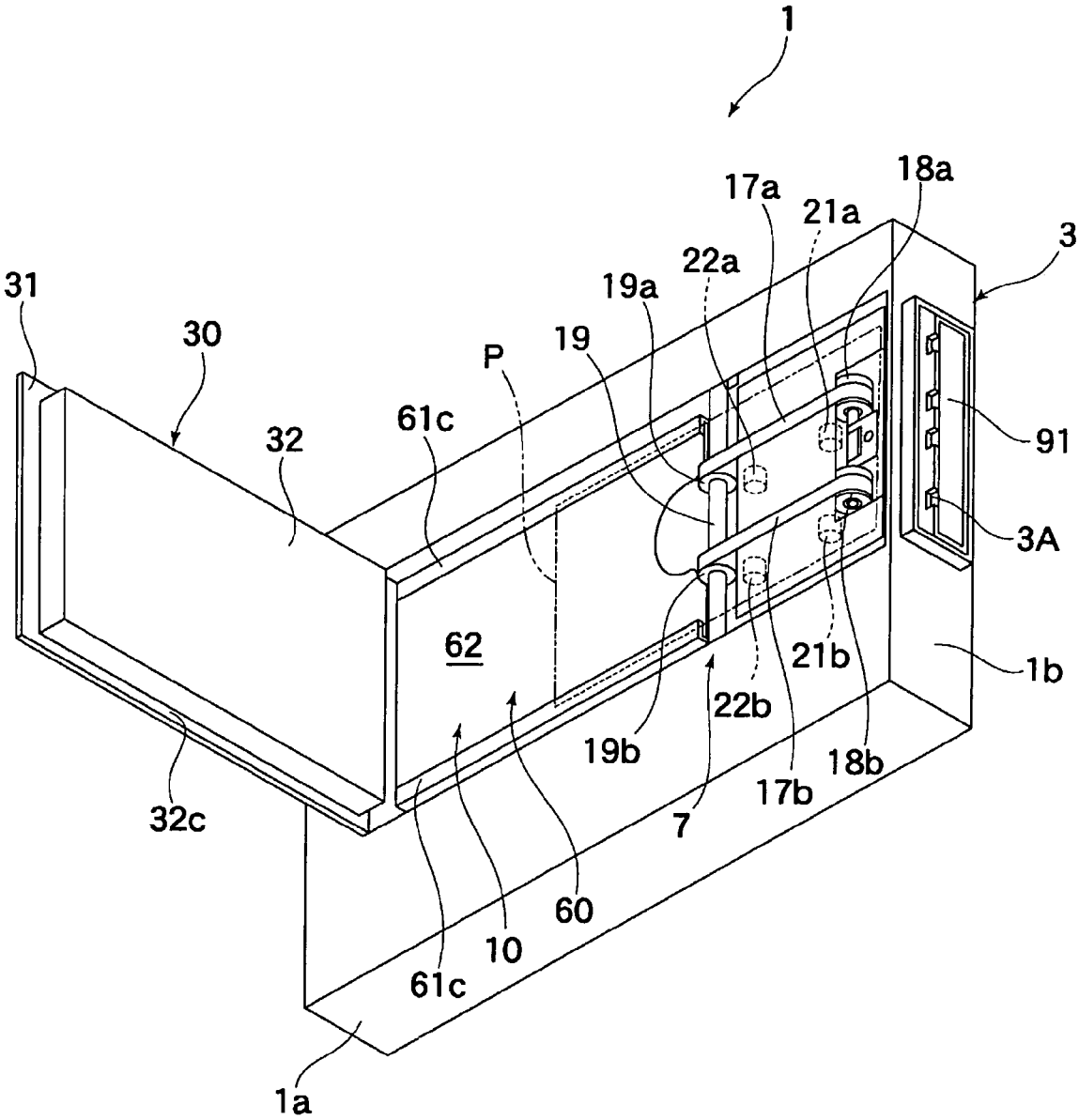
FIG. 2 is a perspective view of the arrangement shown in FIG. 1 when the lid is open.
Figure 3:
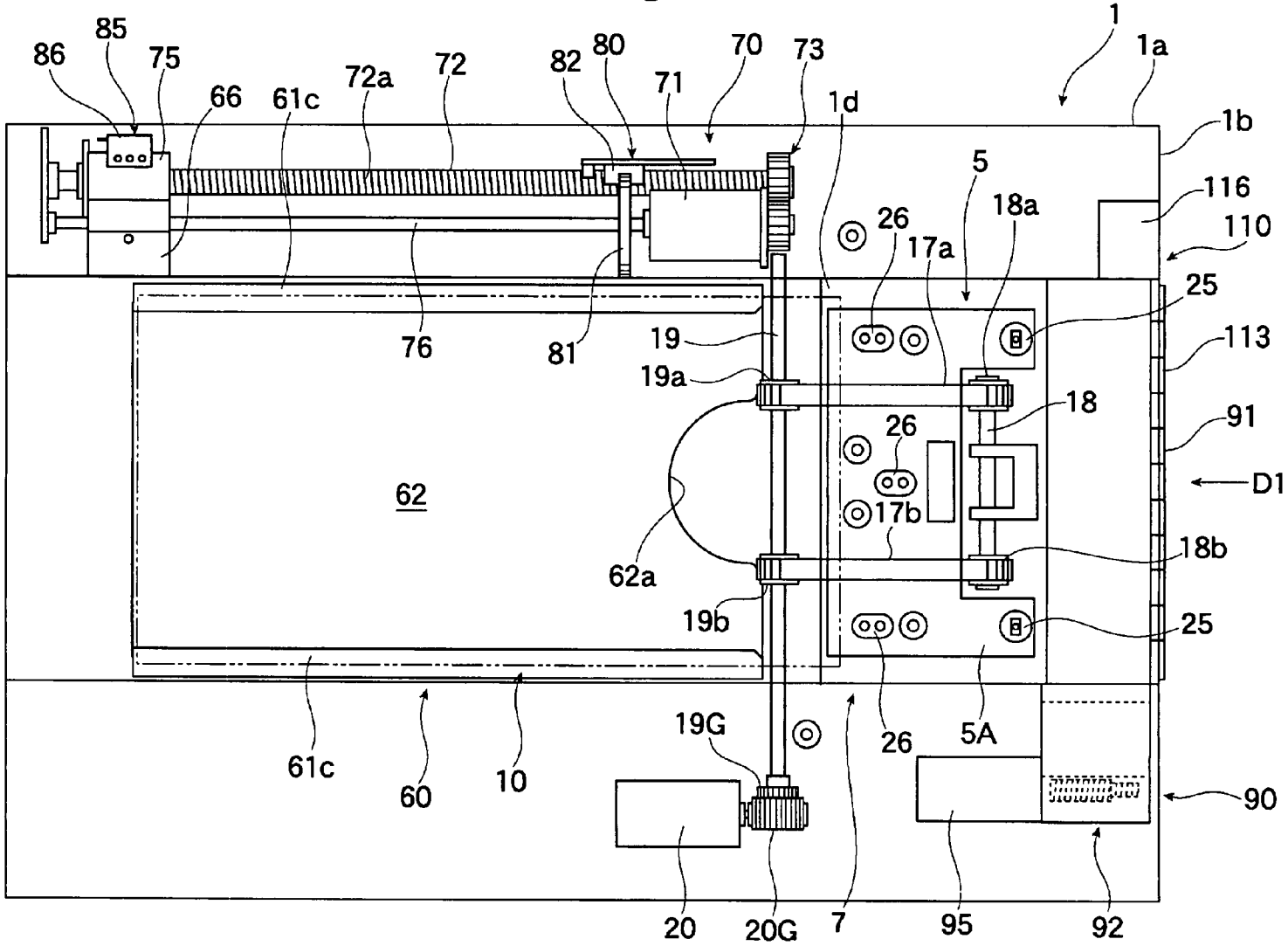
FIG. 3 is a plan view showing the internal arrangement of the bill handling device.

FIGS. 1 to 3 show the arrangement of the bill handling device according to this embodiment. FIG. 1 is a perspective view showing the overall arrangement. FIG. 2 shows the arrangement shown in FIG. 1 when the lid is open. FIG. 3 is a plan view showing the internal arrangement.

A bill handling device 1 is configured such that it can be disposed in a game medium dispensing device installed in between game machines such as Pachinko gaming machines (not shown). In this case, in the game medium dispensing device, other devices (for example, a coin discriminator, a recording medium handling device, and a power supply) are disposed above or below the bill handling device 1. The bill handling device 1 may be integrated with those devices or may be separately configured. Alternatively, the bill handling device 1 may be installed alone or together with the other devices in a space other than in between game machines. The bill handling device 1 then receives a bill, dispenses game mediums, if the inserted bill is validated, according to the value of the bill, and logs the record on a recording medium.

The bill handling device 1 has a rectangular box-like housing l*a*, which is mounted on a locking portion of a game medium dispensing device (not shown). A bill handling area 3 is formed on the front side (the side to be exposed) 1*b* of the housing 1*a*. The bill handling area 3 includes a bill insertion slot 3A that is a slit opening for inserting a bill and an openable/closable shutter 91 formed adjacent to the bill insertion slot 3A, through which a stacking tray (bill container) for stacking and storing bills can be ejected. In this case, a bill P with its shorter side vertically aligned (in an upright position) is inserted inside through the bill insertion slot 3A along the arrow D1 direction.

In the housing 1*a* are provided a bill discriminator 5 for discriminating the validity of the inserted bill and a bill transport mechanism 7 for transporting the inserted bill. The bill discriminator 5 is disposed close to the bill insertion slot 3A in the insertion direction, and the bill transport mechanism 7 is disposed in the area starting from the bill discriminator 5 along the insertion direction D1. The bill transport mechanism 7 transports the inserted bill while sandwiching it therein. The bill transport mechanism 7 is sized smaller than the longitudinal length of the bill, preferably one half of the bill or smaller and disposed in the area close to the bill insertion inlet 3A in the insertion direction.

Downstream of the bill transport mechanism 7 is provided a bill push area 10 where the bill ejected by a pair of downstream rollers that form the bill transport mechanism is pushed in a sliding manner. The bill push area 10 has roughly the same size as the bill such that the bill ejected from the pair of downstream rollers can be pushed without any restriction or change in the arrow D2 direction that is perpendicular to the ejection direction. On opposite sides of the bill push area 10 thus located downstream of the bill transport mechanism 7 are provided a bill press mechanism 30 on one side of the housing and a stacking tray (bill container) 60 on the other side. Specifically, the bill ejected by the transport operation of the bill transport mechanism 7 into the bill push area 10 is pressed in the arrow D2 direction by a press plate of the bill press mechanism 30 as will be described later, and successively stacked and stored in the stacking tray 60.

The bill transport mechanism 7 includes a pair of transport belts 17*a* and 17*b* extending along the bill insertion direction D1 and spaced apart by a predetermined distance. On one side, i.e., on the bill insertion slot 3A side, the transport belts 17*a* and 17*b* engage tension rollers 18*a* and 18*b*, respectively, mounted on a shaft 18 rotatably supported on an internal frame 1*d*. On the other side, i.e., on the rear side of the bill discriminator 5, the transport belts 17*a* and 17*b* engage tension rollers 19*a* and 19*b*, respectively, mounted on a shaft 19 rotatably supported on the internal frame 1*d*.

The shaft 19 is rotated by a transport motor 20 disposed on the internal frame 1*d*. Specifically, the shaft 19 is rotated via a gear 19G mounted on one end of the shaft 19, which engages a gear 20G mounted on the drive shaft of the transport motor 20. The transport motor 20 is controlled by a controller, which will be described later, in such a manner that it rotates in forward/reverse directions and functions as a drive source of the bill transport mechanism 7.

The tension rollers 18*a*, 18*b*, 19*a* and 19*b* abut pinch rollers 21*a*, 21*b*, 22*a* and 22*b*, respectively. That is, the bill P inserted through the bill insertion slot 3A is sandwiched between the transport belts 17*a*, 17*b* and the pinch rollers 21*a*, 21*b*, 22*a* and 22*b* abutted thereagainst and eventually transported to a nip portion between the pinch rollers 22*a*, 22*b* and the transport belts 17*a*, 17*b*, through which the bill P is ejected into the bill push area 10.

The bill discriminator 5 includes a sensor board 5A, on which a bill insertion detection sensor 25 is provided between the bill insertion slot 3A and the shaft 18. The bill insertion detection sensor 25 comprises, for example, an optical sensor and detects that a bill was inserted in the bill insertion slot 3A. Upon the detection of the bill insertion through the bill insertion detection sensor 25, a controller, which will be described later, rotates the transport motor 20 in the bill feed direction (forward direction).

On the sensor board 5A is also provided a bill discrimination sensor 26 between the shafts 18 and 19. The bill discrimination sensor 26 comprises an optical sensor and projects light onto the bill when it is transported by the bill transport mechanism 7. A plurality of bill discrimination sensors 26 is disposed along the direction perpendicular to the bill insertion direction D1. The detected data in the form of reflected or transmitted light from the bill is compared in a CPU in the controller, which will be described later, with genuine bill data pre-stored in a ROM, and it is determined whether or not the bill is genuine.

A bill press mechanism 30 is provided on one side of the housing. The bill press mechanism 30 includes a lid 31 that opens and closes with respect to the housing 1*a*, a press plate 32 that is provided on the lid 31 and presses the bill in the arrow D2 direction when the lid is closed with respect to the housing 1*a* and the bill is positioned in the bill push area 10, and a plate drive motor for driving the press plate 32.

Figure 4:
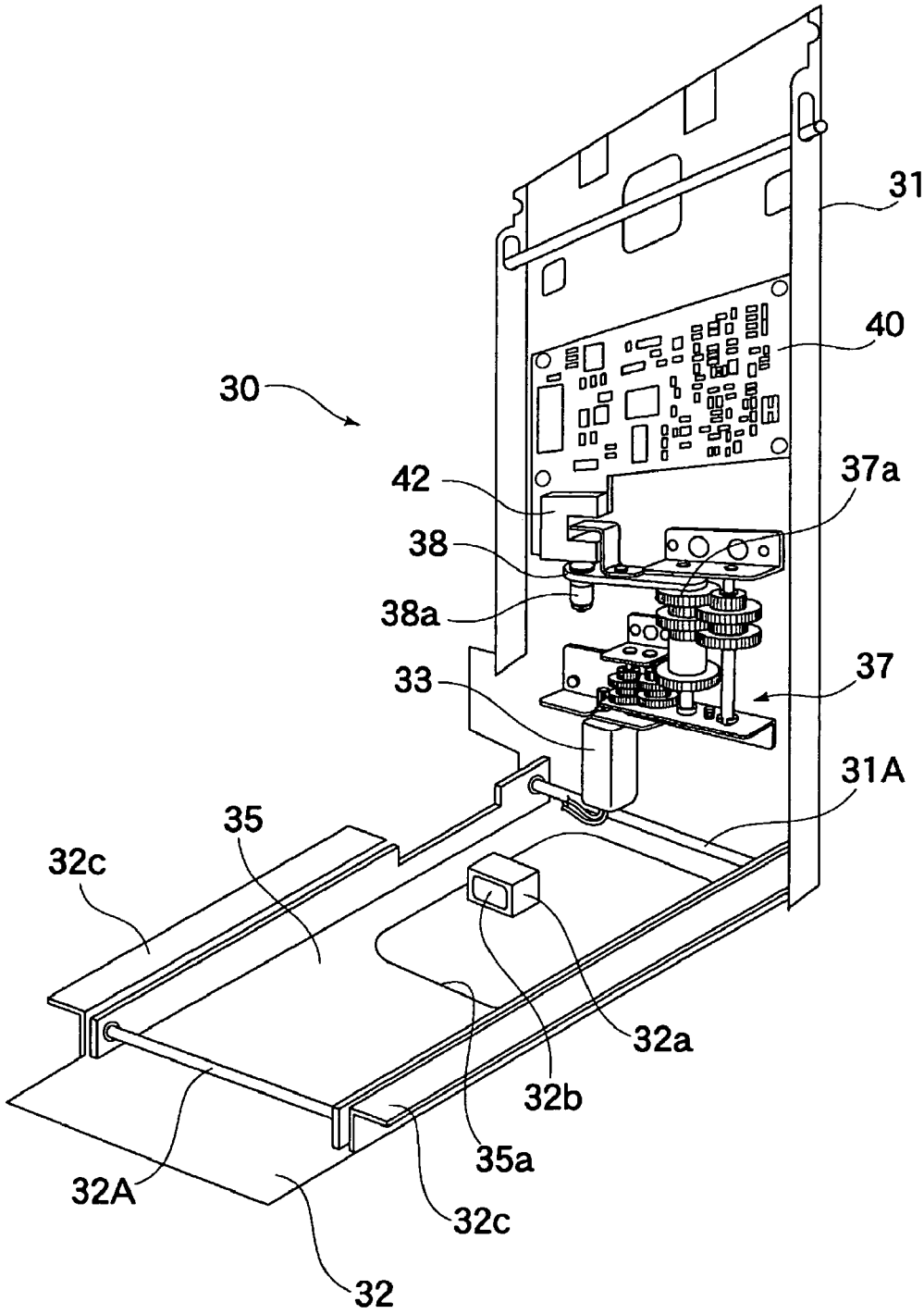
FIG. 4 shows the arrangement of the bill press mechanism when the press plate is released from the lid.
Figure 5:
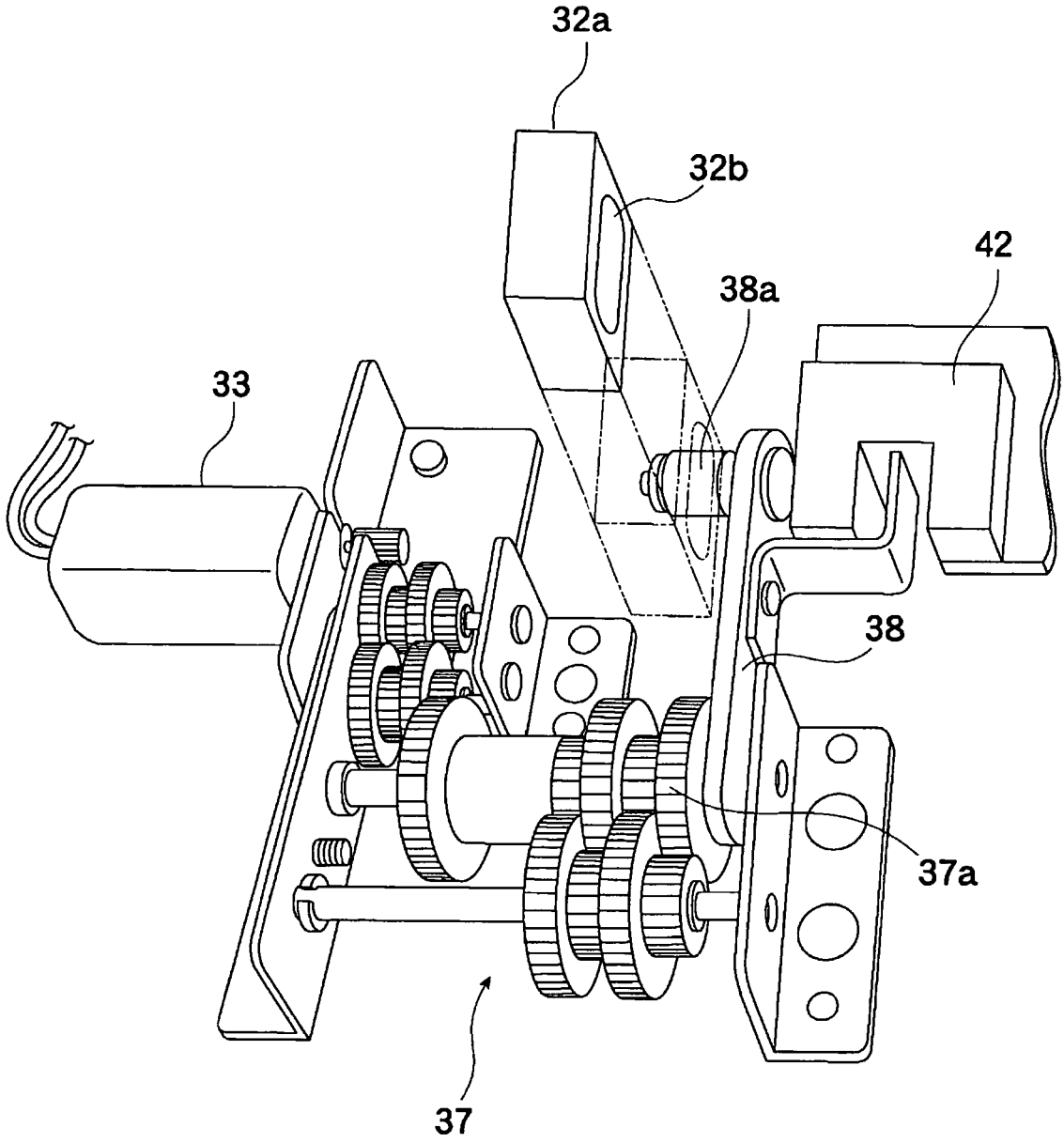
FIG. 5 shows the arrangement of the plate drive motor and the deceleration mechanism thereof.
Figure 6:
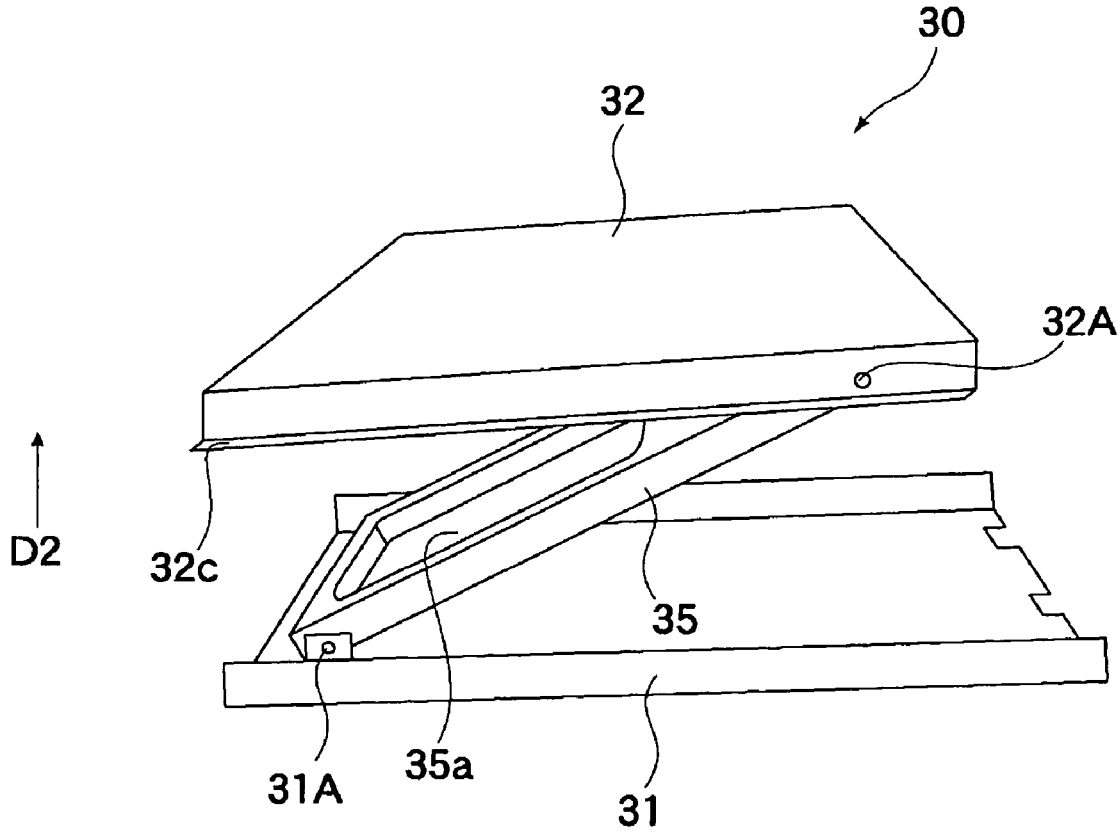
FIG. 6 shows the arrangement of the link mechanism connecting the press plate and the lid.
Figure 7A:
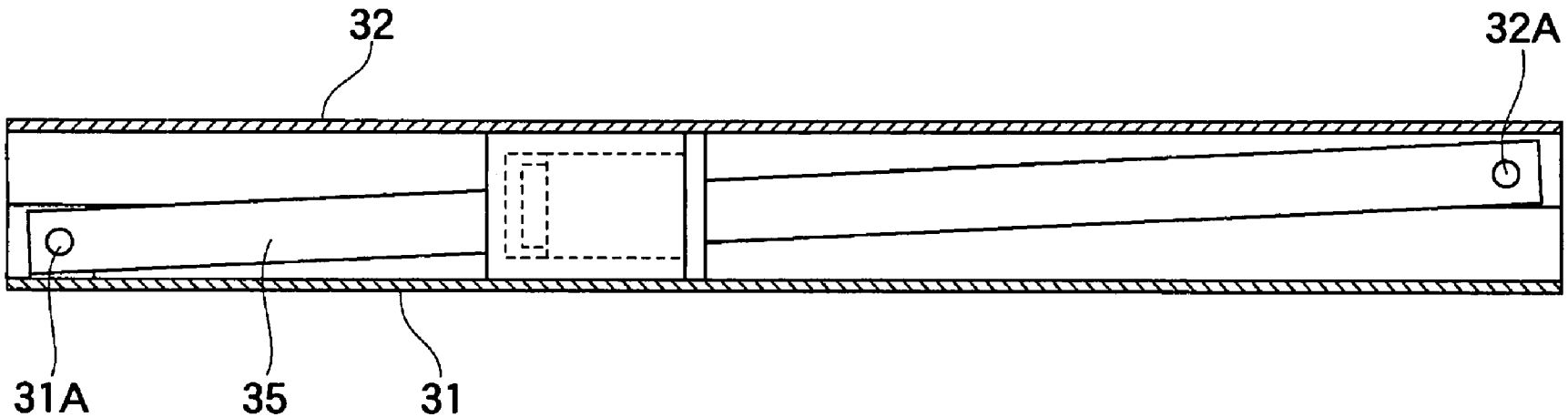
FIG. 7A shows the operation of the press plate in the non-pressing mode.
Figure 7B:
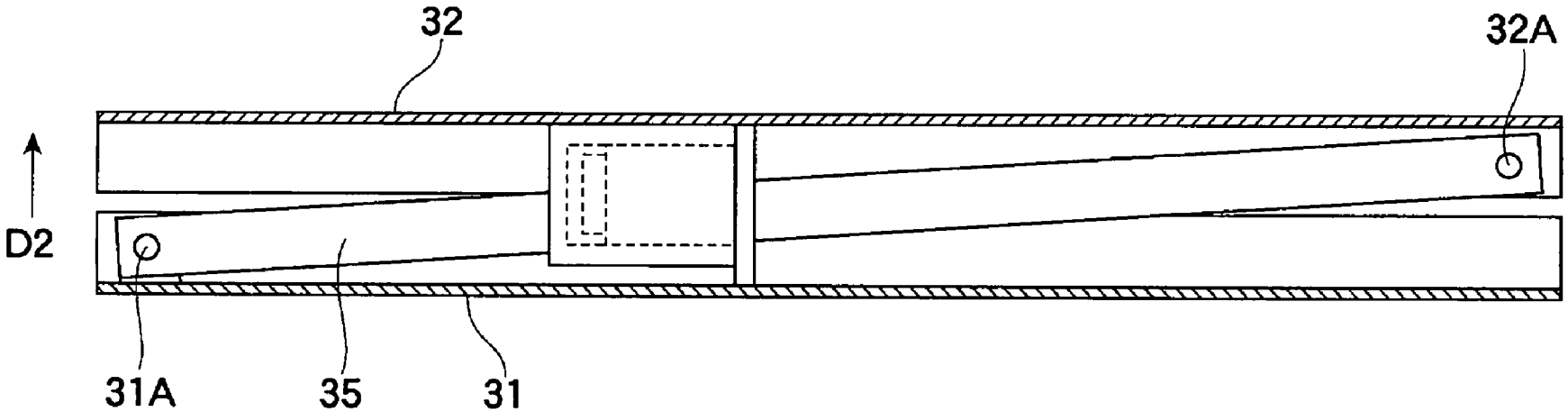
FIG. 7B shows the operation of the press plate in the pressing mode.

The arrangement of the bill press mechanism 30 will be described below with reference to FIGS. 4 to 7. FIG. 4 shows the arrangement when the press plate is released from the lid. FIG. 5 shows the arrangement of the plate drive motor and the deceleration mechanism thereof. FIG. 6 shows the arrangement of the link mechanism connecting the press plate and the lid (the control circuit board and the like are omitted). FIGS. 7A and 7B show the operation of the pressing plate in non-pressing and pressing modes, respectively.

The press plate 32 has roughly the same size as the bill and is supported on the lid 31 movably in the arrow D2 direction by a link mechanism 35 connecting one side of the rear of the press plate 32 and the opposite side of the rear of the lid 31. The link mechanism 35 is pivotably supported on both sides by shafts 31A and 32A provided on the lid 31 and press plate 32, respectively. The link mechanism thus configured supports the press plate 32 such that the press plate 32 moves toward and away from the lid 31 while they maintain a parallel relationship, as shown in FIGS. 6 and 7.

The plate drive motor 33 is disposed on the rear of the lid 31. The rotary motion of the plate drive motor 33 is converted to a reciprocal motion of the press plate 32 in the arrow D2 direction.

On the rear of the lid 31 are provided a deceleration mechanism (gear train) 37 for decelerating the rotary motion of the plate drive motor 33 and transmitting the decelerated rotary motion to the press plate 32, and a pivotable push-down arm 38 that is pivoted by a final gear 37*a* of the deceleration mechanism 37. The final gear 37*a* is fixed to the base end of the push-down arm 38 such that it is pivoted around its base end. At the front end of the push-down arm 38 is fixed an engage projection 38*a*, which engages an elongated groove 32*b* formed in a projecting member 32*a* mounted on the rear of the press plate 32. The pivotal motion of the push-down arm 38 around its base end is converted to a reciprocal motion of the press plate 32 in the arrow D2 direction. As shown in FIG. 4, the projecting member 32*a* is exposed through an aperture 35*a* formed in the link mechanism 35 such that the projecting member 32*a* does not interfere with the motion of the link mechanism 35.

The press plate 32 is shaped such that it hangs down a predetermined length toward the press direction and a flange (overhang) 32*c* is formed on each longitudinal side of the press plate 32. When the press plate 32 is moved by the push-down arm 38 in the push-down direction and enters the opening of the stacking tray 60 (which will be described later) to a certain depth, both the flanges 32*c* abut stopper wings 61*c* of the stacking tray 60 (which will be described later), preventing the press plate 32 from entering any further. That is, providing such flanges 32*c* allows the press plate 32, although one side of which is supported by the link mechanism 35, to uniformly press the bill along the longitudinal direction.

In this embodiment, on the rear of the lid 31 is disposed a control circuit board 40 (forming the controller) for controlling the motions of various drive mechanisms in the bill handling device 1. The control circuit board 40 is connected to an optical sensor (pivotal motion detection sensor) 42 for detecting the pivotal travel of the push-down arm 38. The optical sensor 42 is used to stop the motion of the plate drive motor 33 when the pivotal travel of the push-down arm 38, i.e., the travel of the press plate 32 in the push-down direction reaches a predetermined amount. This prevents an unnecessary load from acting on the plate drive motor 33.

On the opposite side of the housing from the bill push area 10 is provided the stacking tray 60, as shown in FIGS. 2 and 3. The stacking tray 60 is configured to successively stack and store the bill pressed by the press plate 32. The arrangement of the stacking tray is described below with reference to FIGS. 8 and 9.

The stacking tray 60 includes a body 61 having a bottom wall 61*a* and side walls 61*b* formed on both sides of the bottom wall 61*a*.

Figure 8A:
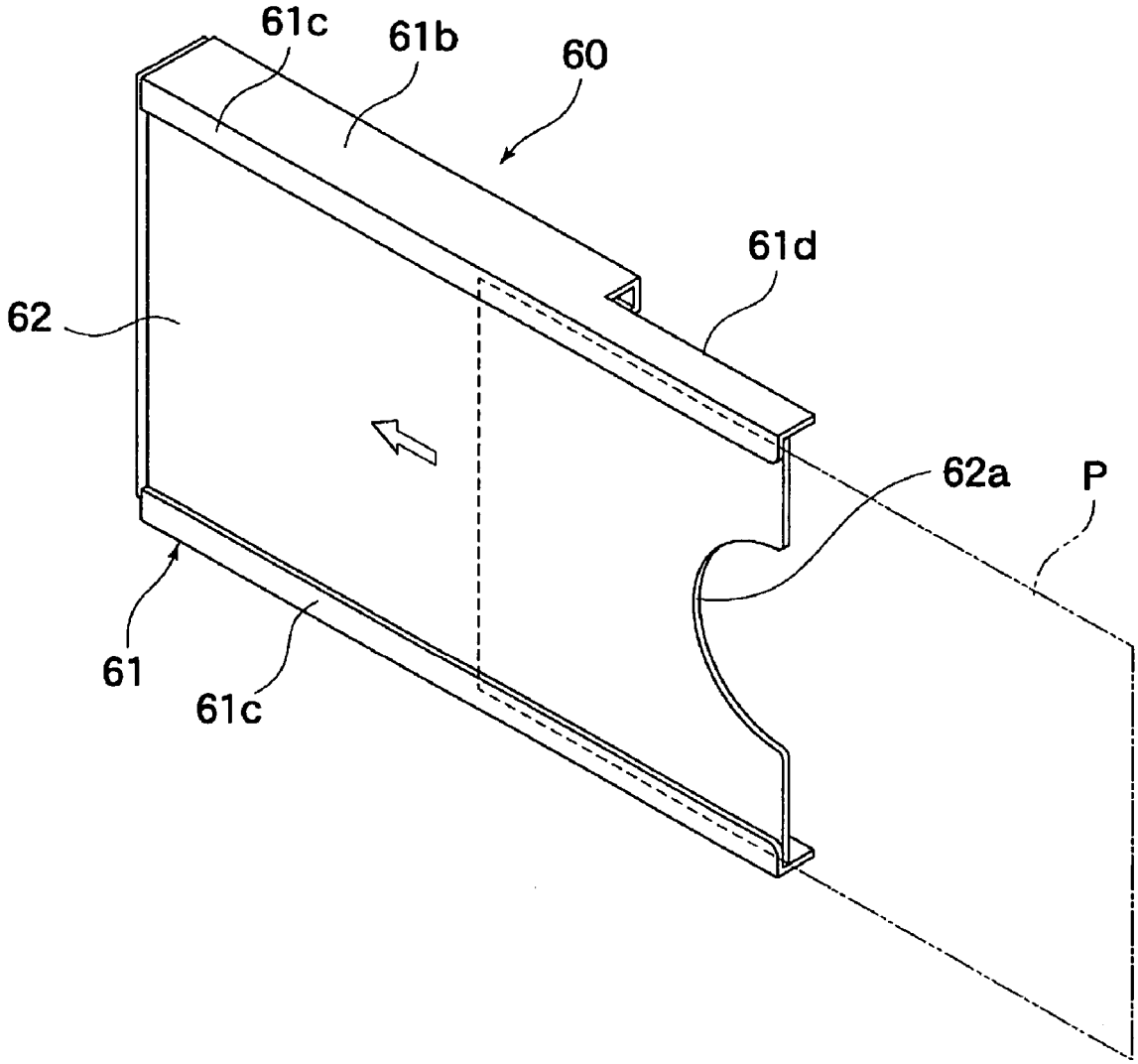
FIG. 8A is a perspective view showing the arrangement of the stacking tray when the bill is ejected in the bill push area.
Figure 8B:
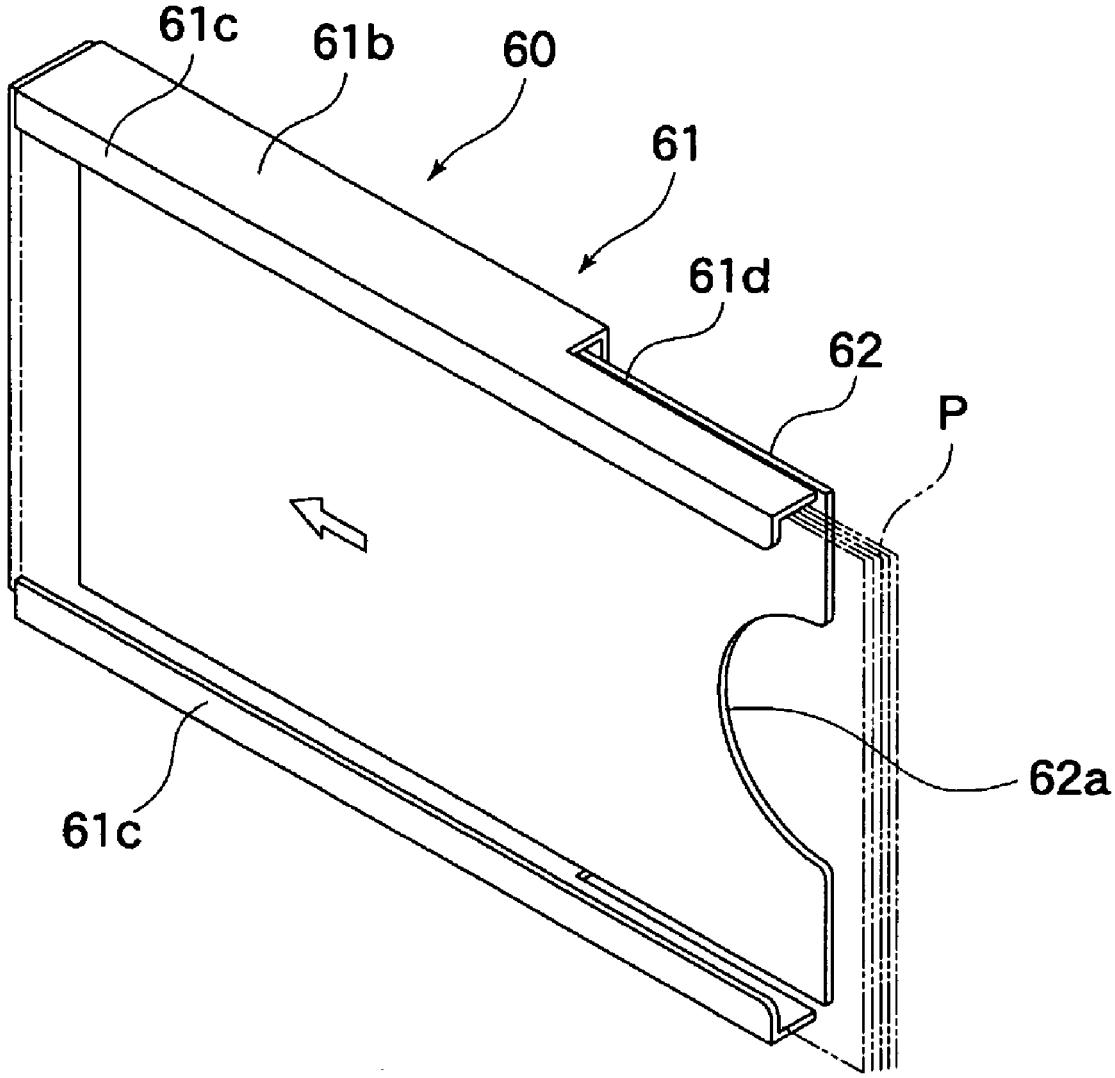
FIG. 8B is a perspective view showing the arrangement of the stacking tray when the bill is stacked and stored.

Between the side walls 61*b* of the body 61 is provided a stacking plate 62 for stacking bills. The stacking plate 62 is pressed and biased in the press direction by a biasing spring 63 disposed between the stacking plate 62 and the bottom wall 61*a* of the body 61. On the opening side of the side walls 61*b* is formed a pair of stopper wings 61*c* extending along the longitudinal direction of a bill to be stored. The stopper wings 61*c* function to separate the bill ejected in the bill push area 10 through the bill transport mechanism 7 from the bills stored in the body 61, as shown in FIGS. 8A and 9A. Specifically, when the press plate 32 presses the bill ejected in the bill push area 10, the center of the bill is bent due to the presence of the stopper wings 61*c* and pushed to the stacking plate 62, as shown in FIG. 9B. Then, the bill passes over the stopper wings 61*c* and is stacked on the stacking plate 62 against the biasing force of the biasing spring 63, as shown in FIGS. 8B and 9C. When the press plate 32 returns to its initial position, the edges of the bills stacked and stored on the stacking plate 62 are pressed against the pair of stopper wings 61*c* by the biasing force of the biasing spring 63.

A gap R is then formed between the topmost bill stacked and stored on the stacking plate 62 and the press plate 32, as shown in FIG. 9A, to separate the stacked and stored bills from the press plate 32. That is, a bill ejected through the bill transport mechanism 7 is delivered in the gap R, and the bill delivered therein is successively stacked and stored in the stacking tray 60 by the motion of the press plate 32 from its initial position.

Too large gap R may cause bill jamming when the bill is crinkled or the like, while too small gap R prevents the bill from being stably delivered. Specifically, a preferable gap between the topmost bill and the press plate 32 is approximately 3 to 5 mm. In the bill push area 10, the bill press mechanism 30 and stacking tray 60 are preferably disposed such that such a gap is formed.

The bills stacked and stored in the body 61 of the stacking tray 60 are held by the pressed and biased stacking plate 62 as well as the stopper wings 61*c*, and in such a configuration, the front end of the bills is exposed. Thus, as described later, when the front portion of the stacking tray 60 is driven to project from the front side 1*b* of the housing 1*a*, the front end portion of the bills stacked and stored on the stacking plate 62 is exposed, allowing the operator easily to pick the bills frontward and collect them.

In this case, the longitudinal length (the length of the bill stacking plane) of the body 61 (stacking plate 62) is preferably shorter than the length of the bill to be inserted, as shown in FIG. 8B. By thus reducing the length of the stacking plate 62, the front end portions of the top and bottom of the bills stacked and stored on the stacking plate 62 are exposed, allowing the operator to easily grab and pick the bills out. Furthermore, with such a configuration, the operator does not have to touch the stacking plate 62 formed of metal, such as stainless steel (e.g., SUS), with the fingers, resulting in increased safety when collecting the bills. Alternatively, as shown in FIG. 8, a recess 62*a* may be formed at the center of the front edge of the stacking plate 62. Such a configuration also allows the operator to grab the bills more easily and again a similar advantage described above can be obtained.

The front portions of the side walls 61*b* of the body 61 that face the housing side are cut to form cutouts 61*d* extending a predetermined length in the bill insertion direction. Those cutouts 61*d* are provided such that when the shutter is released by a shutter mechanism and the stacking tray 60 is moved in the direction in which it projects, the shutter in the open position will not interfere with the body 61, effectively allowing those components to be configured in a space-efficient manner.

In the stacking tray 60, a bill detection sensor 128 for detecting the presence of a bill (see the block diagram of FIG. 14) may be provided on the stacking plate 62.

A stacking tray drive mechanism for driving the stacking tray will be described with reference to FIGS. 3 and 10.

The stacking tray drive mechanism 70 includes a tray drive motor 71 fixed on the internal frame 1*d* of the housing l*a* and a drive shaft (worm shaft) 72 that is rotated by the tray drive motor 71. The drive shaft 72 extending in the bill insertion direction is rotatably supported on the internal frame. A male thread 72*a* is formed on the outer surface of the drive shaft 72. One end of the drive shaft 72 is connected to the output shaft of the tray drive motor 71 via a gear train 73.

At the rear portion of the body 61 of the stacking tray 60 is formed a connecting piece 66, which is connected to a sliding member 75 disposed such that it encloses the drive shaft 72. The sliding member 75 has a female thread (not shown) that engages the male thread 72*a* of the drive shaft 72. The rotary motion of the drive shaft 72 is converted to a reciprocal motion of the sliding member 75, i.e., the stacking tray 60 along the axial direction. In this case, a guide rod 76 disposed parallel to the drive shaft 72 is inserted through the sliding member 75 and the guide rod 76 prevents the sliding member 75 from rotating when it moves back and forth.

The stacking tray drive mechanism 70 also includes a travel detection module 80 capable of detecting the travel of the stacking tray 60. The travel detection module 80 may include a disc-like rotary member 81 mounted on the opposite side extension of the output shaft of the tray drive motor 71, and a rotational travel detection sensor (optical sensor) 82 disposed such that it sandwiches the rotary member 81 with a gap on each side thereof. In the rotary member 81 is formed an encoder 81*a* (a set of openings circumferentially formed at a predetermined interval). As the tray drive motor 71 rotates the encoder 81*a*, the rotational travel detection sensor 82 can obtain pulses corresponding to the rotational travel, providing the travel of the stacking tray 60 based on the number of the pulses.

By providing such a travel detection module 80, it is possible to accurately control the stop position of the stacking tray 60 in the direction in which it projects and reduce the load on the tray drive motor 71.

The stacking tray drive mechanism 70 also includes a position detection module 85 capable of detecting the storing position for the stacking tray 60 (the position to store a bill). Such a position detection module 85 may include a stopper (not shown) provided on the sliding member 75 that moves the stacking tray 60 and a limit switch 86, mounted on the internal frame 1*d*, that the stopper presses and releases to change ON and OFF states thereof.

By providing such a position detection module 85, it is possible to provide the state of the stacking tray 60 (whether it is in the storing position or in the collecting position) and appropriately drive the stacking tray 60 during the bill collection process.

The bills stacked and stored in the stacking tray 60 can be collected in the bill handling area 3 by releasing a shutter mechanism 90 disposed adjacent to the bill insertion slot 3A. The arrangement of the shutter mechanism will be described below with reference to FIGS. 2, 3, and 11 to 13.

The shutter mechanism 90 includes the shutter (blocking plate) 91 that closes a rectangular opening formed in the bill handling area and a shutter drive mechanism 92 for pivoting the shutter 91. The shutter 91 is formed as a generally rectangular plate member and its base end is pivotably supported on a shaft 91*a* with respect to the internal frame of the housing. The shutter drive mechanism 92 includes a shutter drive motor 95, which is connected to the shaft 91*a* via a gear train 96 and link arm members 97*a*, 97*b* sequentially connected to the gear train 96. The gear train 96 forms a deceleration mechanism connected to a drive shaft 95*a* of the shutter drive motor 95.

Specifically, the shutter drive motor 95 rotates its drive shaft 95*a* and the resulting rotational driving force is decelerated through the gear train 96. An output gear 96*a* of the gear train 96 is connected to a shaft of the link member 97*a* and the forward rotation of the shutter drive motor 95 pivots the link member 97*a*, changing its state shown in FIG. 13A to the state shown in FIG. 13B. The base end of the link member 97*b* is connected to the shaft 91*a* and the other end of the link member 97*b* is connected to the link member 97*a*. The pivotal motion of the link member 97*a* as shown in the figure pivots the shutter 91 via the link member 97*b* approximately by 90 degrees from the upright position toward into the housing.

The shutter drive mechanism 92 also includes a pivotal travel detection module 100 capable of detecting the pivotal travel of the shutter 91. The pivotal travel detection module 100 may include an encoder 101 formed in the surface of an input gear 96*b* of the gear train 96 and a rotational travel detection sensor (reflective optical sensor) 102 for detecting the rotational travel of the encoder 101.

By providing such a pivotal travel detection module 100, it is possible to accurately control the stop position of the shutter 91 when it is pivoted approximately by 90 degree and reduce the load on the shutter drive motor 95.

To work with the shutter mechanism 90, a lock mechanism 110 is also provided for holding the shutter 91 at its closed position.

The lock mechanism 110 includes projections and recesses 112 successively formed on the upper edge of the openable/closable shutter 91, a lock plate 113 movable in the width direction of the internal frame of the housing (the direction indicated by the arrow), a drive module, such as a solenoid 116, that can drive the lock plate 113 along the width direction. The lock plate 113 has recesses and projections 114 corresponding to the projections and recesses 112. The lock plate 113 is always biased by a biasing spring 117 such that the projections and recesses 112 and the recesses and projections 114 do not coincide (see FIG. 12).

When collecting the bills, the solenoid 116 drives the lock plate 113 in the width direction against the biasing force of the biasing spring 117 such that the projections and recesses 112 and the recesses and projections 114 coincide (see FIG. 11). This releases the locked shutter 91 and allows the shutter drive mechanism 92 to pivot the shutter 91 toward into the housing, making the stacking tray 60 ready to eject.

FIG. 14 is a block diagram showing an exemplary arrangement of the controller for controlling the operation of the bill handling device 1.

The controller includes, as described above, the control circuit board 40 mounted on the rear of the lid 31 for controlling the operations of the actuators described above. The control circuit board 40 includes a CPU 130 having functions to control the operations of various drive units, such as the transport motor 20, plate drive motor 33, tray drive motor 71, shutter drive motor 95, and solenoid 116, a ROM 131 for storing programs for actuating the various drive units, data for detecting genuine bills and the like, and a control RAM 132.

The CPU 130 is connected to motor drive circuits 140 to 143 for driving the various motors via an I/O port 135. The operations of the drive motors (driving the motors in the forward or reverse direction, and stopping the motors) are controlled using control signals from the CPU 130 based on the programs for actuating those motors. The CPU 130 receives detection signals via the I/O port 135, such as a bill insertion detection signal from the bill insertion detection sensor 25, a bill discrimination signal from the bill discrimination sensor 26, a press position detection signal for the press plate 32 from the pivot motion detection sensor 42, a position detection signal for the stacking tray 60 from the pivotal travel detection sensor 82, a detection signal detecting whether or not the stacking tray 60 is in the storing position from the limit switch 86, and a pivotal position detection signal for the shutter 91 from the rotational travel detection sensor 102. Based on these detection signals, the operations of the transport motor 20, plate drive motor 33, tray drive motor 71, shutter drive motor 95, and solenoid 116 are controlled.

The CPU 130 is connected to a control circuit 200 disposed in the body of the game machine (not shown) and executing the game, and sends the game machine the information on how much the player is worth playing the game based on the value of the bill inserted.

Furthermore, the CPU 130 on the control circuit board 40 receives a release signal for releasing the lock mechanism 110 in the locked mode (for driving the solenoid 116). A signal transmission module 300 for transmitting the release signal can be, for example, configured as part of functions of a management server connected over a communication network 400 and managing the facility in a bank, allowing, for example, the shutters of the bill handling devices in the bank facility to be released in a single operation during the bill collection process.

The operation of the bill handling device 1 configured as described above will now be described.

First, the procedure of successively stacking and storing bills in the stacking tray 60 will be described. As shown in FIGS. 1 to 3, the bill P with its shorter side vertically aligned in an upright position is inserted through the bill insertion slot 3A, which is detected by the bill insertion detection sensor 25. When the bill insertion detection sensor 25 detects that the bill has been inserted, the transport motor 20 is rotated in the forward direction and the bill P is sandwiched by the transport belts 17*a*, 17*b* and the pinch rollers 21*a*, 21*b*, 22*a*, 22*b* abutted thereagainst, which are part of the bill transport mechanism 7, and transported into the housing.

While the bill P is being transported in the housing, the bill discrimination sensor 26 detects the bill and the controller determines its validity. If the bill discrimination sensor 26 cannot determine the validity of the bill P, the transport motor 20 is counterrotated to return the bill P being transported and eject it from the bill insertion slot 3A.

When the bill P is validated, the transport motor 20 is rotated until the rear edge of the bill P passes through the nip portion between the transport belts 17*a*, 17*b* and the pinch rollers 22*a*, 22*b*. At the same time, as shown in FIGS. 8A and 9A, in the bill push area 10 located downstream of the transport belts 17*a*, 17*b* and the pinch rollers 22*a*, 22*b*, the bill P is ejected in the gap R between the press plane of the press plate 32 and the plane including the stopper wings 61*c* of the stacking tray 60. As mentioned above, the gap is set in a certain range such that the gap does not cause jamming or the like.

When the bill passes through the nip portion and reaches the push area 10, the forward rotary motion of the transport motor 20 is stopped and the plate drive motor 33 is rotated. The push-down arm 38 then drives the press plate 32 in the push-down direction and the lower side of the press plate 32 presses the bill (see FIG. 9B). The bill being pressed by the press plate 32 passes over the pair of stopper wings 61*c* of the stacking tray 60 and gets pressed on the stacking plate 62 against the biasing force of the biasing spring 63. Although the press plate 32 provides different pressing forces at different positions of the bill depending on the supporting position of the link mechanism 35, the flanges (overhangs) 32*c* formed on both sides of the press plate 32 touch the stopper wings 61*c*, providing a substantially uniform pressing force on the bill along the longitudinal direction. That is, the entire bill can be uniformly pressed, ensuring that a predetermined number of bills can be stored even when the bill is crimped or hard to be straightened (due to the increased number of the stacked bills). The position of the push-down arm 38 is detected by the pivotal motion detection sensor 42, which detects an appropriate position of the push-down arm 38 (when the flanges 32*c* of the press plate 32 touch the stopper wings 61*c*) and stops the plate drive motor 33.

When a predetermined pressing force is applied to the press plate 32 and the flanges (overhangs) 32*c* touch the stopper wings 61*c*, the plate drive motor 33 is counterrotated to return the press plate 32 to its initial position. At the same time, the stacking plate 62 is biased to the stopper wings 61*c* by the biasing force of the biasing spring 63 and the topmost bill touches the stopper wings 61*c* as shown in FIG. 9C. The bill is now separated from a bill to be subsequently transported.

By repeating the above operations, bills will be stably stacked and stored on the stacking plate 62 of the stacking tray 60.

The procedure of collecting the bills stored in the stacking tray 60 will now be described. When collecting the bills, the management server (signal transmission module 300) for managing the entire parlor, for example, sends a signal for releasing the lock mechanism 110 to each bill handling device 1 installed in a bank. In this case, the management server may, for example, control all the bill handling devices in the bank to release the lock mechanisms thereof, or may control the bill handling devices in one row in the bank to release the lock mechanisms thereof. When the bill handling machine receives this release signal, it drives the solenoid 116, which in turn drives the lock plate 113 in the width direction against the biasing force of the biasing spring 117. Thereby, the recesses and projections 114 of the lock plate 113 and the projections and recesses 112 formed on the shutter 91 coincide. This allows the shutter drive motor 95 to rotate the shutter 91 into the open position (see FIG. 13B). The rotational travel of the shutter drive motor 95 is detected by the rotational travel detection sensor 102, which stops the shutter drive motor 95 at an appropriate position (a position in which the shutter rotates about 90 degrees into the bowed-down position).

When the shutter drive motor 95 is stopped, the tray drive motor 71 is rotated, which ejects the front end portion of the stacking tray 60 from the front side of the housing. As described above, since cutouts 61*d* are formed on both the side walls 61*b* of the body 61 of the stacking tray 60, the front end portion of the stacking tray 60 is ejected without interfering with the shutter 91 in the bowed-down position. The rotational travel of the tray drive motor 71 is detected by the rotational travel detection sensor 82, which stops the stacking tray 60 at an appropriate position.

While the motion of the stacking tray 60 is stopped, the bills stacked on the stacking plate 62 are held such that the front end portion of the bills is exposed as shown in FIG. 15, allowing the operator to grab and pick the exposed bills out and the bill collection process to be carried out in an efficient manner. In particular, in this embodiment as shown in FIG. 8, the length of the stacking plate 62 on which the bill is stacked is shorter than the length of the bill, and in addition, the recess 62*a* is formed at the center of the front edge of the stacking plate 62. Therefore, when the stacking tray 60 projects, the bills stacked and stored can be easily grabbed at their front portion, allowing the bill collection process to be carried out more easily.

During the bill collection process, when the bill detection sensor 128 detects that no bill exists on the stacking plate 62 (when the collection is completed), the above procedure is performed in a reverse order after a predetermined period of time has passed. That is, the tray drive motor 71 is counterrotated to return the stacking tray 60 to its storing position. When the limit switch 86 detects the presence of the stacking tray 60, the shutter drive motor 95 is counterrotated to pivot the shutter 91 into the closed position. Thereafter, the solenoid 116 is de-energized to return the lock plate 113 to its initial position, and the lock mechanism 110 is actuated.

Since the absence of a bill on the stacking plate 62 is detected and the lock mechanism 110 is automatically actuated as described above, the operator has nothing to do but collect bills, allowing the bill collection process to be carried out in an efficient manner. Such an arrangement reliably eliminates the possibility that the operator forgets to lock the shutter 91 (human error) in the bill collection process, resulting in increased security. The controller described above may be configured such that when it receives the signal for releasing the lock mechanism but no bill exists on the stacking plate 62, the controller will not release the lock mechanism. That is, when no bill exists, the stacking tray 60 will not be driven and the locking state of the lock mechanism is maintained, reliably eliminating the possibility that the operator forgets to actuate the lock mechanism.

The process of releasing the lock mechanism 110 described above may be carried out through a dedicated mobile terminal in possession of the operator. For example, each bill handling device may have an infrared light receiver 500 (see FIGS. 1 and 14), through which the lock mechanism 110 is released when the infrared light receiver receives a predetermined lock release signal from the mobile terminal. That is, with such an arrangement, the collection process can be carried out for a large number of bill handling devices by releasing the individual lock mechanisms. Alternatively, such a release operation may be carried out in a single operation using the mobile terminal via the management server. That is, the lock mechanisms may be released for the entire bank or for each one row in the bank in a single operation using the mobile terminal.

The bill handling device configured as described above can be downsized by disposing the various component members in a limited amount of installation space in a space-efficient manner and efficient bill collection is further realized.

That is, in the arrangement of the above described bill handling device, a bill inserted through the bill insertion slot 3A is transported by the bill transport mechanism 7 and ejected toward the gap R in the bill push area 10 located downstream of the bill transport mechanism 7. Since in the bill push area 10, there is no transport mechanism (such as transport rollers) for transporting bills in the insertion direction, space can be provided in the lateral direction of the housing l*a*, where the bill press mechanism 30 and the stacking tray 60 for stacking and storing bills can be disposed in the lateral direction in a space-efficient manner. This eliminates the need to dispose the bill container for storing bills above or below the bill transport mechanism 7, allowing the entire device to be more compact.

Furthermore, since the separation between the stacking tray 60 and a bill to be inserted is simply carried out by the stopper wings 61*c* formed for that purpose on the stacking tray 60, it is possible to simplify the structure and effectively use the space in the housing.

In the above arrangement, since various drive mechanisms are disposed in the housing, wiring space is required for connecting the drive mechanisms, control circuit boards, and external devices. In this case, patterning signal lines and communication lines on the sensor board 5A mounted between the side walls of the housing may eliminate the need for wiring, allowing the internal space to be efficiently used and the entire device to be more compact.

The bill press mechanism 30 successively stacks and stores bills from the bill push area 10 in the stacking tray 60, which is then ejected by the stacking tray drive mechanism 70 and its front end portion projects from the front side of the housing l*a*. The bills stacked and stored in the stacking tray 60 are held such that the front end portion of the bills is exposed, allowing the operator to simply pick the exposed bills frontward and the bill collection process to be carried out in an efficient manner. Furthermore, the bills are reliably held between the stopper wings 61*c* of the stacking tray 60 and the stacking plate 62, eliminating the possibility of uncollected bills remained in the housing in the collection process.

Although embodiments of the invention have been described above, the invention is not limited thereto and can be modified as appropriate. For example, the component members, such as the various drive mechanisms and sensors, disposed in the housing are merely one example and their specific arrangements can be modified as appropriate as long as they provide similar processes and operations. The arrangement of the stacking tray 60 may be modified as appropriate as long as it holds the bills such that when the stacking tray 60 projects from the housing, the front end portion of the bills are exposed to be picked out. Furthermore, the system for releasing the lock mechanism of the bill handling device may be configured such that the release operation is performed for each bill handling device without involving an external management server or the like. That is, the collection process may be individually carried out for each bill handling device.

The bill handling device of the invention can be installed not only in between various game machines but also in various devices that handle bills, such as outside devices like various automatic vending machines.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill handling device comprising:

a housing;

a bill insertion slot provided on a front side of the housing, through which a bill can be inserted;

a bill transport mechanism configured to transport the bill inserted from the bill insertion slot along the bill insertion direction and ejecting the bill toward a bill push area located downstream of the bill transport mechanism;

a bill press mechanism provided on one side of the housing and pressing the bill ejected in the bill push area toward an other side thereof;

a stacking tray configured to move along the insertion direction, between a collection position for receiving the bill and a storage position for storing the bill pressed by the bill press mechanism therein;

a stacking tray drive mechanism configured to move the stacking tray from the collection position to the storage position; and a shutter mechanism having a shutter provided on the housing, the shutter mechanism opening and closing the shutter through which a front end portion of the stacking tray can project, the shutter mechanism having a lock mechanism for preventing the shutter from opening;

wherein the stacking tray holds the bill such that when the front end portion of the stacking tray projects from the housing through the shutter, the front end portion of the stacked and stored bill is exposed.

2. The bill handling device according to claim 1, wherein the stacking tray includes stopper wings engageable with the both longitudinal edges of the bill, a bill stacking plate for stacking the bill, and a biasing spring for pressing the bill stacked on the bill stacking plate toward the stopper wings.

3. The bill handling device according to claim 2, wherein the stacking tray is formed such that the length of the bill stacking plate is shorter than the length of the inserted bill.

4. The bill handling device according to claim 1, wherein the stacking tray drive mechanism has a travel detection module capable of detecting the travel of the stacking tray.

5. The bill handling device according to claim 1, wherein the stacking tray drive mechanism has a position detection module for detecting whether or not the stacking tray is in a storing position in the housing.

6. The bill handling device according to claim 2, wherein a recess is formed in the bill stacking plate.

7. A bill handling device control system comprising:

a bill handling device which includes, a housing having a bill insertion slot on a front side thereof, through which a bill can be inserted;

a bill transport mechanism configured to transport the bill inserted from the bill insertion slot along the bill insertion direction and ejecting the bill toward a bill push area located downstream of the bill transport mechanism;

a bill press mechanism provided on one side of the housing and pressing the bill ejected in the bill push area toward an other side thereof;

a stacking tray configured to move along the insertion direction between a collection position for receiving the bill and a storage position for storing the bill pressed by the bill press mechanism therein, a stacking tray drive mechanism configured to move the stacking tray from the collection position to the storage position;

a shutter mechanism having a shutter provided on the housing, the shutter mechanism opening and closing the shutter through which a front end portion of the stacking tray can project, the shutter mechanism having a lock mechanism for preventing the shutter from opening and is configured to hold the bill such that when a front end portion of the stacking tray projects from the housing through the shutter a front end portion of the stacked end stored bill is exposed;

a signal transmission module configured to transmit a release signal for releasing the lock mechanism to the bill handling device; and a controller configured to drive the shutter mechanism to open the shutter and driving the stacking tray drive mechanism such that the stacking tray projects from the housing when the bill handling device received the release signal.

8. The bill handling device control system according to claim 7, wherein the stacking tray is provided with a bill detection sensor for detecting the presence of a bill, and when the bill detection sensor does not detect the presence of a bill and the stacking tray remains projected from the housing for a predetermined period of time, the controller controls the stacking tray drive mechanism to return the stacking tray into the housing.

9. The bill handling device control system according to claim 7, wherein the stacking tray is provided with a bill detection sensor configured to detect the presence of a bill, and when the bill detection sensor does not detect the presence of a bill, the controller drives the lock mechanism to lock the shutter to prevent it from opening.

10. A bill handling device comprising:

a housing;

a bill insertion slot provided on a front surface side of the housing, through which a bill can be inserted;

a bill transport mechanism configured to transport the bill inserted from the bill insertion slot along the bill insertion direction and ejecting the bill toward a bill push area located downstream of the bill transport mechanism;

a bill press mechanism provided on one side of the housing and pressing the bill ejected in the bill push area toward a other side thereof;

a stacking tray configured to move along the insertion direction, between a collection position for receiving the bill and a storage position for storing the bill pressed by the bill press mechanism therein;

a stacking tray drive mechanism configured to move the stacking tray from the collection position to the storage position; and a shutter mechanism being disposed on a front surface of the housing adjacent to the bill insertion slot and having a shutter provided on the front surface of the housing, the shutter mechanism opening and closing the shutter through which a front end portion of the stacking tray can project, the shutter mechanism having a lock mechanism for preventing the shutter from opening;

wherein the stacking tray holds the bill such that when a front end portion of the stacking tray projects from the housing through the shutter, the front end portion of the stacked and stored bill is exposed.

* * * * *